US010281105B2

(12) United States Patent
Owada

(10) Patent No.: US 10,281,105 B2
(45) Date of Patent: May 7, 2019

(54) LENS BODY FOR VEHICLE CONFIGURED TO EMIT LIGHT FORWARD FROM A LIGHT SOURCE AND LIGHTING TOOL FOR VEHICLE

(71) Applicant: STANLEY ELECTRIC CO., LTD., Tokyo (JP)

(72) Inventor: Ryotaro Owada, Yokohama (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/948,903

(22) Filed: Apr. 9, 2018

(65) Prior Publication Data

US 2018/0299090 A1 Oct. 18, 2018

(30) Foreign Application Priority Data

Apr. 14, 2017 (JP) ..... 2017-080631

(51) Int. Cl.

| | |
|---|---|
| ***F21S 41/26*** | (2018.01) |
| ***F21S 41/32*** | (2018.01) |
| ***F21S 41/16*** | (2018.01) |
| ***F21V 7/08*** | (2006.01) |
| ***F21S 41/176*** | (2018.01) |

(Continued)

(52) U.S. Cl.

CPC ..... *F21S 41/26* (2018.01); *F21S 41/147* (2018.01); *F21S 41/16* (2018.01); *F21S 41/176* (2018.01); *F21S 41/265* (2018.01); *F21S 41/27* (2018.01); *F21S 41/285* (2018.01); *F21S 41/32* (2018.01); *F21S 41/322* (2018.01); *F21S 41/43* (2018.01); *F21V 7/08* (2013.01); *F21S 45/48* (2018.01); *F21W 2102/30* (2018.01); *F21Y 2115/30* (2016.08)

(58) Field of Classification Search

CPC ..... F21S 41/26; F21S 41/285; F21S 41/176

See application file for complete search history.

(56) References Cited

FOREIGN PATENT DOCUMENTS

| | | |
|---|---|---|
| EP | 1357333 A2 | 10/2003 |
| EP | 2565521 A2 | 3/2013 |

(Continued)

OTHER PUBLICATIONS

The extended European Search Report for the related European Patent Application No. 18166834.4 dated Aug. 27, 2018.

*Primary Examiner* — Joseph L Williams

(74) *Attorney, Agent, or Firm* — Kenealy Vaidya LLP

(57) ABSTRACT

A lens body includes a first reflecting surface totally reflecting entered light, a second reflecting surface totally reflecting at least some of the light totally reflected at the first reflecting surface, and a light emitting surface emitting light passed through forward, wherein the first reflecting surface includes an elliptical spherical shape with reference to a front-focal point and a rear-focal point disposed parallel with each other in the forward/rearward direction, the rear-focal point disposed in a vicinity of a light source, the light emitting surface has a first leftward/rightward emission region and a second leftward/rightward emission region adjacent to the first leftward/rightward emission region in a leftward/rightward direction, the first leftward/rightward emission region refracts the entered light in a direction approaching a forward/rearward reference axis, and the second leftward/rightward emission region refracts at least some of the entered light in a direction getting away from the forward/rearward reference axis.

13 Claims, 15 Drawing Sheets

(51) Int. Cl.

| | |
|---|---|
| ***F21S 41/20*** | (2018.01) |
| ***F21S 41/147*** | (2018.01) |
| ***F21S 41/265*** | (2018.01) |
| ***F21S 41/27*** | (2018.01) |
| ***F21S 41/43*** | (2018.01) |
| *F21S 45/48* | (2018.01) |
| *F21W 102/30* | (2018.01) |
| *F21Y 115/30* | (2016.01) |

(56) References Cited

FOREIGN PATENT DOCUMENTS

| | | | |
|---|---|---|---|
| EP | 2993392 | A1 | 3/2016 |
| EP | 3109542 | A1 | 12/2016 |
| EP | 3181992 | A1 | 6/2017 |
| FR | 3010772 | A1 | 3/2015 |
| JP | 4047186 | B2 | 2/2008 |

LENS BODY FOR VEHICLE CONFIGURED TO EMIT LIGHT FORWARD FROM A LIGHT SOURCE AND LIGHTING TOOL FOR VEHICLE

CROSS-REFERENCE TO RELATED APPLICATION

Priority is claimed on Japanese Patent Application No. 2017-080631, filed Apr. 14, 2017, the content of which is incorporated herein by reference.

BACKGROUND

Field of the Invention

The present invention relates to a lens body and a lighting tool for a vehicle.

Description of Related Art

In the related art, a lighting tool for a vehicle in which a light source and a lens body are combined has been proposed (for example, Japanese Patent No. 4047186). In the lighting tool for a vehicle, light from the light source enters the lens body from an incidence part of the lens body, some of the light is reflected by a reflecting surface of the lens body, and then, the light exits from a light emitting surface of the lens body to the outside of the lens body.

SUMMARY

In the lighting tool for a vehicle of the related art, a metal reflection film (a reflecting surface) is formed on a surface of the lens body through metal deposition, and the light reflected by the metal reflection film is radiated forward. For this reason, loss of light may occur in the reflecting surface to cause a decrease in utilization efficiency of the light. In addition, in the above-mentioned lighting tool for a vehicle, since the light is concentrated on and radiated to a central region, the illuminance to the left and right thereof is insufficient in comparison with that at the center.

An aspect of the present invention is to provide a lighting tool for a vehicle and a lens body that are capable of effectively distributing light in a leftward/rightward direction while efficiently using light from a light source.

A lens body of an aspect of the present invention is a lens body that is disposed in front of a light source and that is configured to emit light from the light source forward along a forward/rearward reference axis extending in a forward/rearward direction of a vehicle, the lens body including: an incidence part through which the light from the light source enters; a first reflecting surface that totally reflects the light entered from the incidence part; a second reflecting surface that totally reflects at least some of the light totally reflected at the first reflecting surface; and a light emitting surface that emits the light passed through forward, wherein the first reflecting surface includes an elliptical spherical shape with reference to a front focal point and a rear focal point that are disposed parallel with each other in the forward/rearward direction, the rear focal point is disposed in a vicinity of the light source, the second reflecting surface is formed as a reflecting surface extending from a vicinity of the front focal point toward a rear side, the light emitting surface has a convex shape in a cross section along a surface perpendicular to a leftward/rightward direction of the vehicle, the light emitting surface has a first leftward/rightward emission region through which the forward/rearward reference axis passes, and a second leftward/rightward emission region adjacent to the first leftward/rightward emission region in the leftward/rightward direction, the first leftward/rightward emission region refracts the entered light passed through the front focal point in a direction approaching the forward/rearward reference axis when seen in an upward/downward direction, the second leftward/rightward emission region refracts at least some of the entered light passed through the front focal point in a direction getting away from the forward/rearward reference axis when seen in the upward/downward direction, and among the light totally reflected at the first reflecting surface, a light that has reached the light emitting surface without being reflected at the second reflecting surface, and a light that has been totally reflected by the second reflecting surface and that has reached the light emitting surface, are radiated forward by being emitted from the light emitting surface, respectively.

In the above-mentioned configuration, the first reflecting surface may have a first reflective region and a second reflective region respectively including an elliptical spherical shape with reference to the front focal point and the rear focal point that are disposed parallel with each other in the forward/rearward direction, the rear focal points of the first reflective region and the second reflective region may coincide with each other, the front focal points of the first reflective region and the second reflective region may be disposed at different positions when seen in the upward/downward direction, a light passed through the front focal point of the first reflective region may be emitted forward via the first leftward/rightward emission region, and a light passed through the front focal point of the second reflective region may be emitted forward via the second leftward/rightward emission region.

In the above-mentioned configuration, the light emitting surface may have a single first leftward/rightward emission region, and a pair of the second leftward/rightward emission region respectively disposed on both sides of the first leftward/rightward emission region in the leftward/rightward direction, the first reflecting surface may have a single first reflective region, and a pair of the second reflective region respectively disposed on both sides of the first reflective region in the leftward/rightward direction, a light passed through one of the front focal point among the pair of the second reflective region may be emitted forward via one of the second leftward/rightward emission region among the pair of second leftward/rightward emission region, and a light passed through the other one of the front focal point among the pair of second reflective region may be emitted forward via the other one of the second leftward/rightward emission region among the pair of second leftward/rightward emission region.

In the above-mentioned configuration, the front focal point of the first reflective region may overlap with the forward/rearward reference axis when seen in the upward/downward direction, and the front focal point of the second reflective region may be disposed so as to be shifted from the forward/rearward reference axis in the leftward/rightward direction when seen in the upward/downward direction.

In the above-mentioned configuration, in the first reflective region, a distance between the front focal point and the rear focal point; an eccentricity; an angle of a major axis, through which the front focal point and the rear focal point pass, with respect to the forward/rearward reference axis; and an angle of an optical axis of the light source with respect to the forward/rearward reference axis, may be set so that the entered light is totally reflected at the first reflecting surface.

In the above-mentioned configuration, in the second reflective region, a distance between the front focal point and the rear focal point; an eccentricity; an angle of a major axis, through which the front focal point and the rear focal point pass, with respect to the forward/rearward reference axis; and an angle of an optical axis of the light source with respect to the forward/rearward reference axis, may be set so that the entered light is totally reflected at the first reflecting surface.

In the above-mentioned configuration, in the first reflective region, the major axis through which the front focal point and the rear focal point pass may be inclined with respect to the forward/rearward reference axis, and the rear focal point may be disposed below the front focal point.

In the above-mentioned configuration, in the second reflective region, the major axis through which the front focal point and the rear focal point pass may be inclined with respect to the forward/rearward reference axis, and the rear focal point may be disposed below the front focal point.

In the above-mentioned configuration, an angle of the second reflecting surface with respect to the forward/rearward reference axis may be set such that the light totally reflected at the second reflecting surface among the light totally reflected at the first reflecting surface is captured by the light emitting surface.

In the above-mentioned configuration, an angle of the second reflecting surface with respect to the forward/rearward reference axis and a length of the second reflecting surface in the forward/rearward direction may be set so that the second reflecting surface does not shield the light which is totally reflected at the first reflecting surface and which reaches the light emitting surface without being totally reflected at the second reflecting surface.

In the above-mentioned configuration, a front edge of the second reflecting surface may extend forward from a central section thereof so that a portion positioned more outer side in the leftward/rightward direction is positioned more forward.

In the above-mentioned configuration, the second reflecting surface may have a main surface section, and a subsidiary surface section shifted from the main surface section in the upward/downward direction, and at least a portion of a boundary section between the main surface section and the subsidiary surface section may extend rearward from the front edge.

A lighting tool for a vehicle of an aspect of the present invention includes the lens body and the light source.

An aspect of the present invention is to provide a lens body capable of employing a lighting tool for a vehicle configured to effectively diffuse light in a leftward/rightward direction while efficiently using light from a light source, and a lighting tool for a vehicle including the same.

DESCRIPTION OF EMBODIMENTS

First Embodiment

Figure 1:
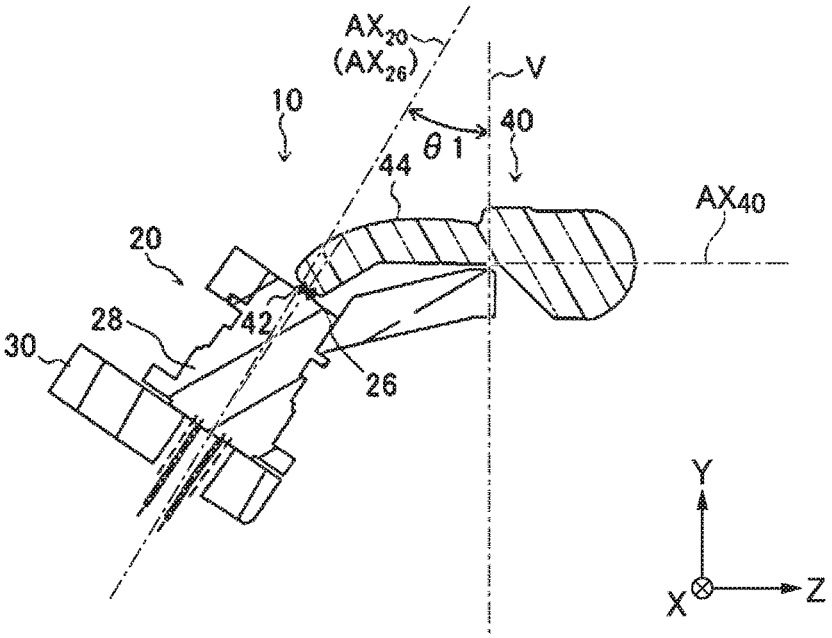
FIG. 1 is a cross-sectional view of a lighting tool for a vehicle of a first embodiment.

Hereinafter, a lens body 40 and a lighting tool 10 for a vehicle including the lens body 40 according to a first embodiment of the present invention will be described with reference to the accompanying drawings.

In the following description, a forward/rearward direction is referred to as a forward/rearward direction of a vehicle on which the lens body 40 or the lighting tool 10 for a vehicle is mounted, and the lighting tool 10 for a vehicle is a member configured to radiate light forward. Further, the forward/rearward direction is one direction in a horizontal surface unless the context indicates otherwise. Further, a leftward/rightward direction is one direction in the horizontal surface and a direction perpendicular to the forward/rearward direction unless the context indicates otherwise.

In the specification, extending in the forward/rearward direction (or extending forward/rearward) also includes extending in a direction inclined within a range of less than 45° with respect to the forward/rearward direction, in addition to extending strictly in the forward/rearward direction. Similarly, in the specification, extending in the leftward/rightward direction (or extending leftward/rightward) also includes extending in a direction inclined within a range of less than 45° with respect to the leftward/rightward direction, in addition to extending strictly in the leftward/rightward direction.

In addition, in the drawings, an XYZ coordinate system serving as an appropriate three-dimensional orthogonal coordinate system is shown. In the XYZ coordinate system, a Y-axis direction is an upward/downward direction (a vertical direction), and a +Y direction is an upward direction. In addition, a Z-axis direction is a forward/rearward direction, and a +Z direction is a forward direction (a front side). Further, an X-axis direction is a leftward/rightward direction.

Further, the drawings used in the following description may show enlarged particular parts for convenience in order to allow easy understanding of the characterized parts, and dimensional ratios or the like of the components may not be equal to that in actuality.

In addition, in the following description, the case in which two points are "disposed adjacent to each other" includes the case in which two points coincide with each other as well as the case in which two points are simply disposed close to each other.

FIG. 1 is a cross-sectional view of the lighting tool 10 for a vehicle. In addition, FIG. 2 is a partial cross-sectional view of the lighting tool 10 for a vehicle.

As shown in FIG. 1, the lighting tool 10 for a vehicle includes the lens body 40, a light emitting device 20, and a heat sink 30 configured to cool the light emitting device 20. The lighting tool 10 for a vehicle emits the light radiated from the light emitting device 20 toward a forward side via the lens body 40.

Figure 2:
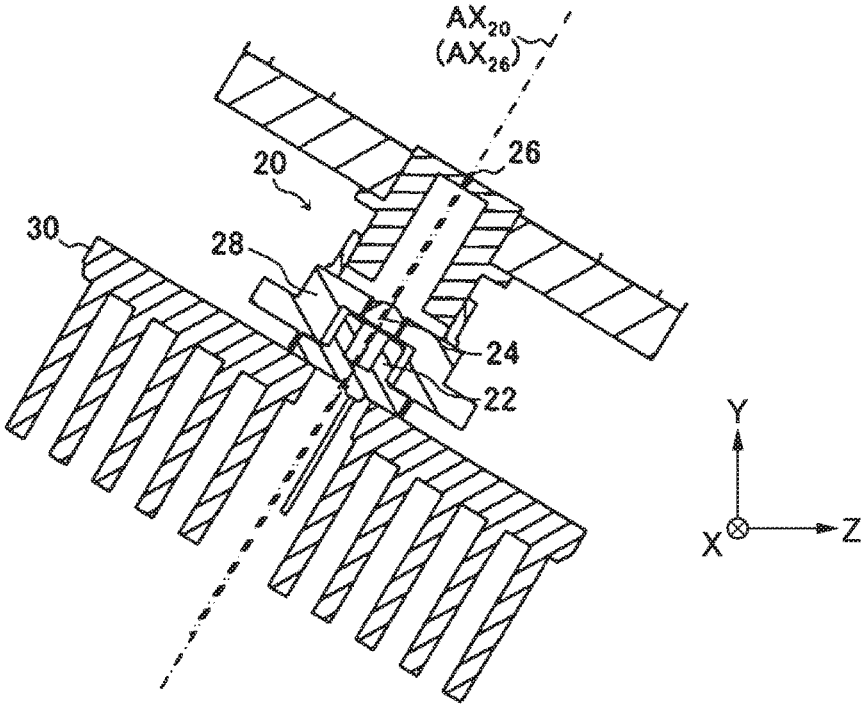
FIG. 2 is a partial cross-sectional view of the lighting tool for a vehicle of the first embodiment.

As shown in FIG. 2, the light emitting device 20 radiates light along an optical axis $AX_{20}$. The light emitting device 20 has a semiconductor laser element 22, a condensing lens 24, a wavelength conversion member (a light source) 26, and a holding member 28 configured to hold these. The semiconductor laser element 22, the condensing lens 24 and the wavelength conversion member 26 are sequentially disposed along the optical axis $AX_{20}$.

The semiconductor laser element 22 is a semiconductor laser light source such as a laser diode or the like configured to discharge laser light of a blue region (for example, an emission wavelength is 450 nm). The semiconductor laser element 22 is mounted on, for example, a CAN type package and sealed therein. The semiconductor laser element 22 is held on the holding member 28 such as a holder or the like. Further, as another embodiment, a semiconductor emitting device such as an LED device or the like may be used instead of the semiconductor laser element 22.

The condensing lens 24 concentrates laser light from the semiconductor laser element 22. The condensing lens 24 is disposed between the semiconductor laser element 22 and the wavelength conversion member 26.

The wavelength conversion member 26 is constituted by, for example, a fluorescent body of a rectangular plate shape having a light emitting size of 0.4×0.8 mm. The wavelength conversion member 26 is disposed at a position spaced, for example, about 5 to 10 mm from the semiconductor laser element 22. The wavelength conversion member 26 receives the laser light concentrated by the condensing lens 24 and converts at least some of the laser light into light having a different wavelength. More specifically, the wavelength conversion member 26 converts laser light of a blue region into yellow light. The light in a yellow region converted by the wavelength conversion member 26 is mixed with the laser light of the blue region passing through the wavelength conversion member 26 and discharged as white light (quasi white light). Accordingly, the wavelength conversion member 26 functions as a light source configured to discharge white light. Hereinafter, the wavelength conversion member 26 is also referred to as the light source 26.

The light radiated from the light source 26 enters an incident surface 42, which will be described below, to advance through the lens body 40, and is internally reflected by a first reflecting surface 44 (see FIG. 1) described below.

The optical axis $AX_{26}$ of the light source 26 coincides with the optical axis $AX_{20}$ of the light emitting device 20. As shown in FIG. 1, the optical axis $AX_{26}$ is inclined at an angle θ1 with respect to a vertical axis V extending in a vertical direction (a Y-axis direction). The angle θ1 of the optical axis $AX_{26}$ with respect to the vertical axis V is set such that an incident angle of the light from the light source entering the lens body 40 from the incident surface 42 with respect to the first reflecting surface 44 (i.e., a first reflective region 44A and a second reflective region 44B, which will be described below) is a critical angle or more.

Figure 3A:
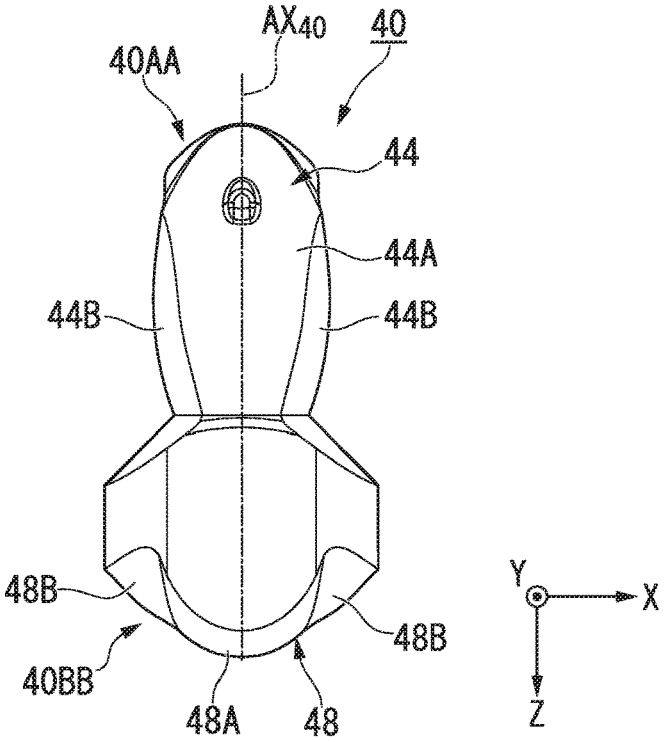
FIG. 3A is a plan view of a lens body of the first embodiment.
Figure 3B:
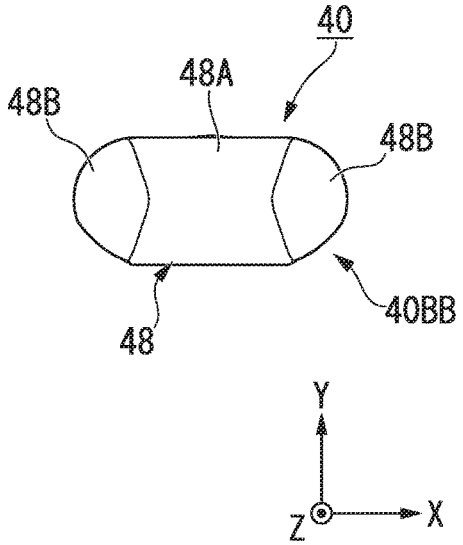
FIG. 3B is a front view of the lens body of the first embodiment.
Figure 3C:
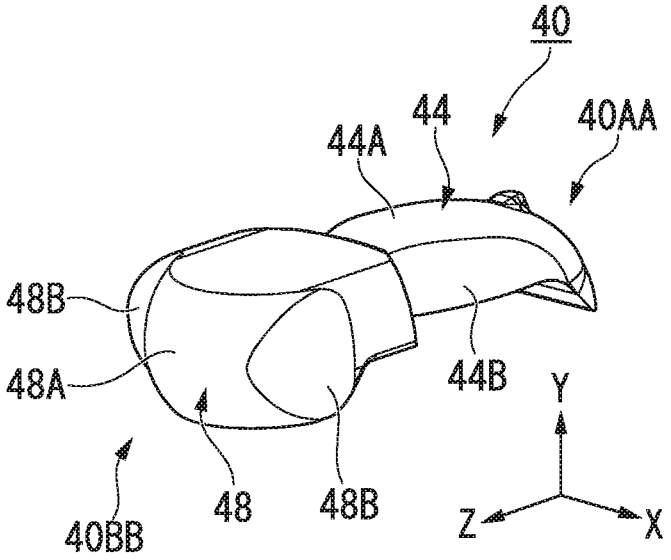
FIG. 3C is a perspective view of the lens body of the first embodiment.
Figure 3D:
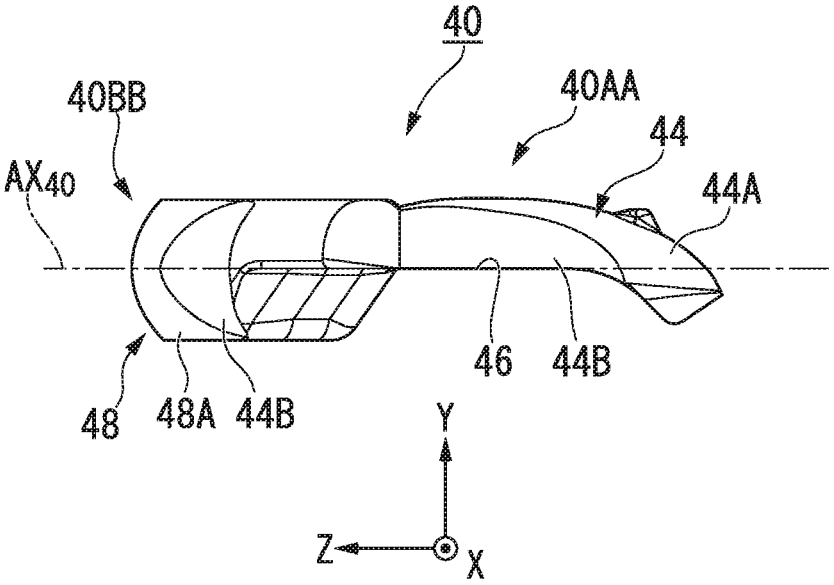
FIG. 3D is a side view of the lens body of the first embodiment.
Figure 3E:
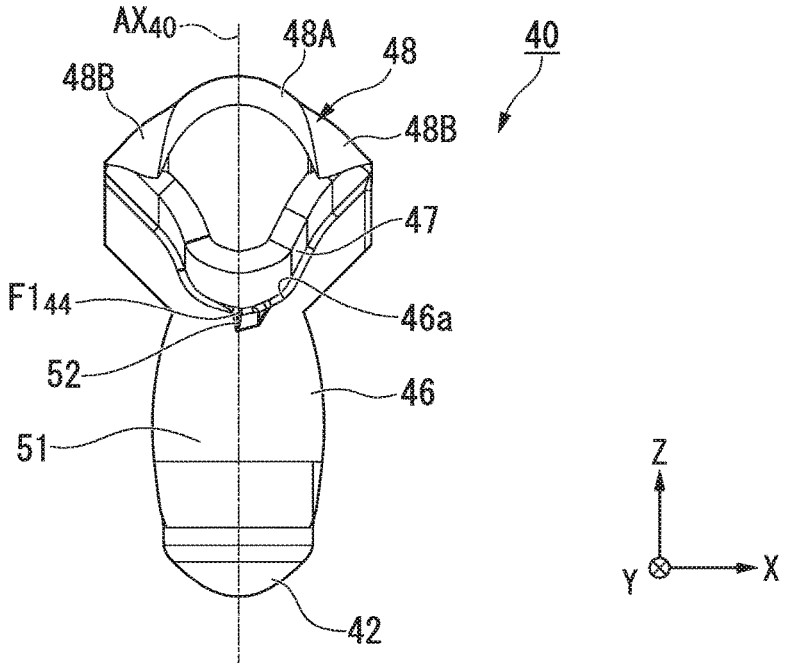
FIG. 3E is a bottom view of the lens body of the first embodiment.

FIG. 3A is a plan view of the lens body 40, FIG. 3B is a front view of the lens body 40, FIG. 3C is a perspective view of the lens body 40, FIG. 3D is a side view of the lens body 40 and FIG. 3E is a bottom view of the lens body 40.

Figure 4:
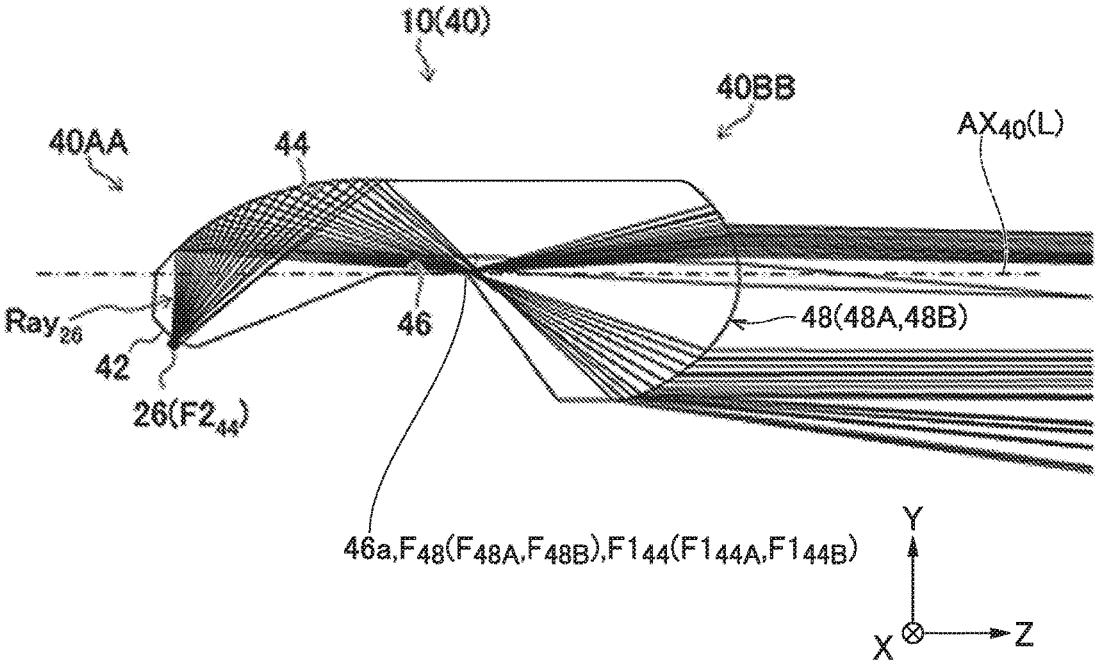
FIG. 4 is a cross-sectional view of the lens body of the first embodiment along an YZ plane.

FIG. 4 is a cross-sectional view of the lens body 40 along an YZ plane, schematically showing an optical path through which light from the light source 26 enters the lens body 40.

The lens body 40 is a solid multi-face lens body having a shape extending along a forward/rearward reference axis $AX_{40}$. Further, in the embodiment, the forward/rearward reference axis $AX_{40}$ is an axis extending in a forward/rearward direction (a Z-axis direction) of a vehicle and serving as a reference line passing through a center of a light emitting surface 48 of the lens body 40, which will be described below. The lens body 40 is disposed in front of the light source 26. The lens body 40 includes a rear end portion 40AA directed rearward, and a front end portion 40BB directed forward.

The lens body 40 can be formed of a material having a higher refractive index than that of air, for example, a transparent resin such as polycarbonate, acryl, or the like, glass, or the like. In addition, when a transparent resin is used for the lens body 40, the lens body 40 can be formed through injecting molding using a mold.

The lens body 40 has the incident surface (an incidence part) 42, the first reflecting surface 44, a second reflecting surface 46 and the light emitting surface 48. The incident surface 42 and the first reflecting surface 44 are disposed at the rear end portion 40AA of the lens body 40. In addition, the light emitting surface 48 is disposed at the front end portion 40BB of the lens body 40. The second reflecting surface 46 is disposed between the rear end portion 40AA and the front end portion 40BB.

As shown in FIG. 4, the lens body 40 emits light $Ray_{26}$ from the light source 26 entering the lens body 40 from the incident surface 42 disposed at the rear end portion 40AA forward from the light emitting surface 48 disposed at the front end portion 40BB along the forward/rearward reference axis $AX_{40}$. Accordingly, the lens body 40 forms a low beam light distribution pattern P (see FIG. 13) including a cutoff line CL at an upper edge, which will be described below.

Figure 5A:
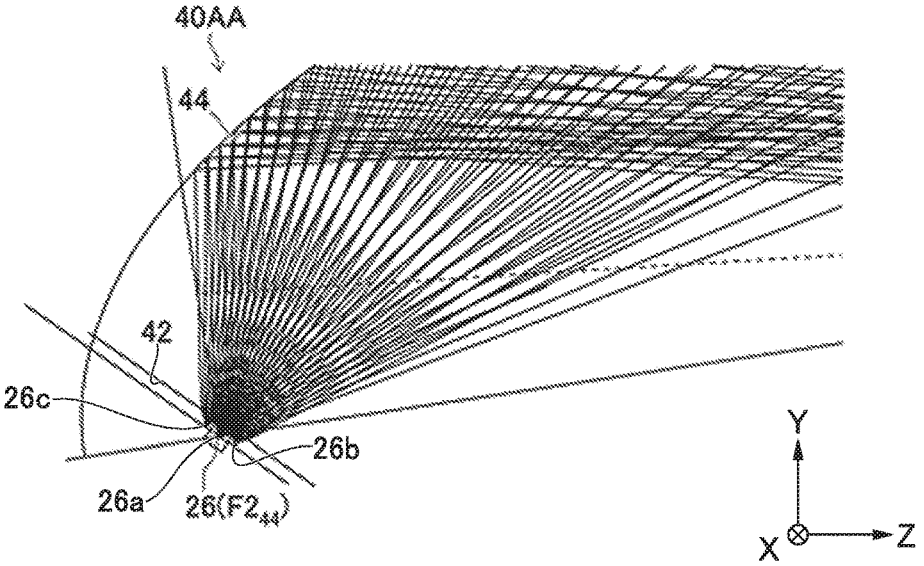
FIG. 5A is a partially enlarged view of a light source of the first embodiment and the vicinity of an incident surface of the lens body.

FIG. 5A is a partially enlarged view of the vicinity of the light source 26 and the incident surface 42 of the lens body 40.

The light source 26 has a light emitting surface with a predetermined area. For this reason, the light radiated from the light source 26 is radially spreading from points on the light emitting surface. The light passing through the lens body 40 follows optical paths different according to light emitted from the points in the light emitting surface. In the specification, description will be performed in consideration of the optical path of light radiated from a light source central point 26*a* serving as a center of the light emitting surface (i.e., a center of the light source 26), a light source front end point 26*b* serving as an end point of a forward side, and a light source rear end point 26*c* serving as an end point of a rearward side.

Figure 5B:
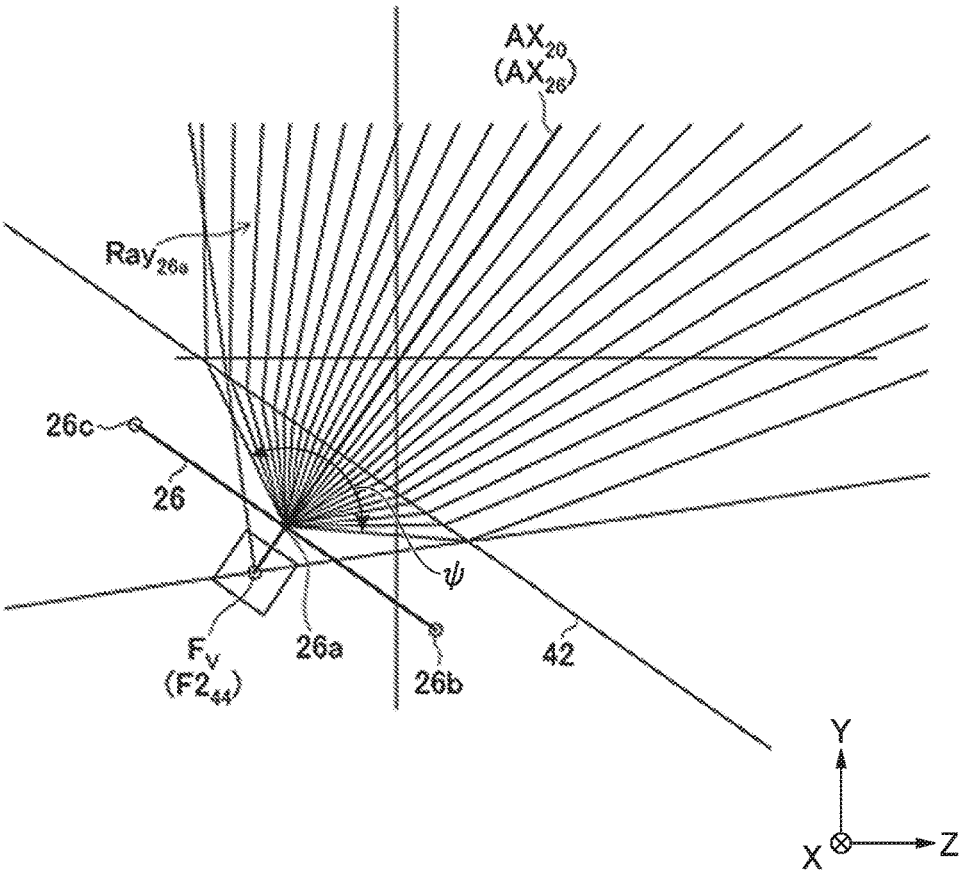
FIG. 5B is an enlarged view of a portion of FIG. 5A.

FIG. 5B is a view showing a route of the light emitted from the light source central point 26*a*, which is an enlarged view of a portion of FIG. 5A. In the specification, an intersection in which when the lights, which are from the light source central point 26*a* and which enter the lens body 40 after refracted at the incident surface 42, are extended in the opposite direction is set as an imaginary light source position $F_v$.

The imaginary light source position $F_v$ is a position of the light source, provided that the light source is integrally disposed in the lens body 40. Further, in the embodiment, since the incident surface 42 is a plane but not a lens surface, the lights entering the lens body 40 do not cross each other at one point even when the lights are extended in opposite direction. More specifically, the light crosses at a rearward side on an optical axis L as it goes away from the optical axis L. For this reason, the intersection at which the optical path closest to the optical axis L crosses is set as the imaginary light source position $F_v$.

As shown in FIG. 5B, the incident surface 42 is a surface at which light within a predetermined angular range $\phi$ among light $Ray_{26a}$ from the light source 26 is refracted in a condensing direction to enter the lens body 40. Here, the light within the predetermined angular range $\phi$ is light having high relative intensity within a range of, for example, ±60° with respect to the optical axis $AX_{26}$ of the light source 26 among the light radiated from the light source 26. In the embodiment, the incident surface 42 is configured as a surface with a plane shape (or a curved surface shape) parallel with respect to the light emitting surface of the light source 26 (in FIG. 5B, see a straight line that connects the light source front end point 26*b* and the light source rear end point 26*c*). Further, a configuration of the incident surface 42 is not limited to the configuration of the embodiment. For example, the incident surface 42 may have a linear-shaped cross-sectional shape in a vertical surface (and a plane parallel thereto) including the forward/rearward reference axis $AX_{40}$, and a cross-sectional shape in a plane perpendicular to the forward/rearward reference axis $AX_{40}$, which is an arc-shaped surface concave toward the light source 26, but may be other surfaces. The cross-sectional shape in the plane perpendicular to the forward/rearward reference axis $AX_{40}$ is a shape obtained in consideration of a distribution in the leftward/rightward direction of the low beam light distribution pattern P.

Figure 6:
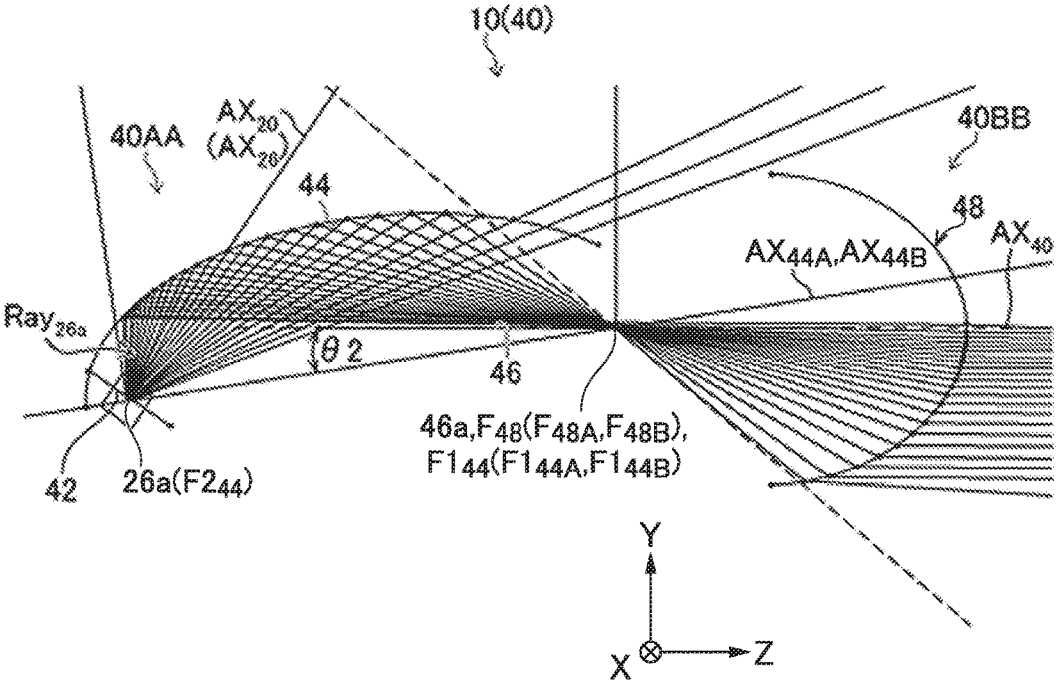
FIG. 6 is a cross-sectional schematic view of the lens body of the first embodiment, showing an optical path of light radiated from a central point of the light source.
Figure 7:
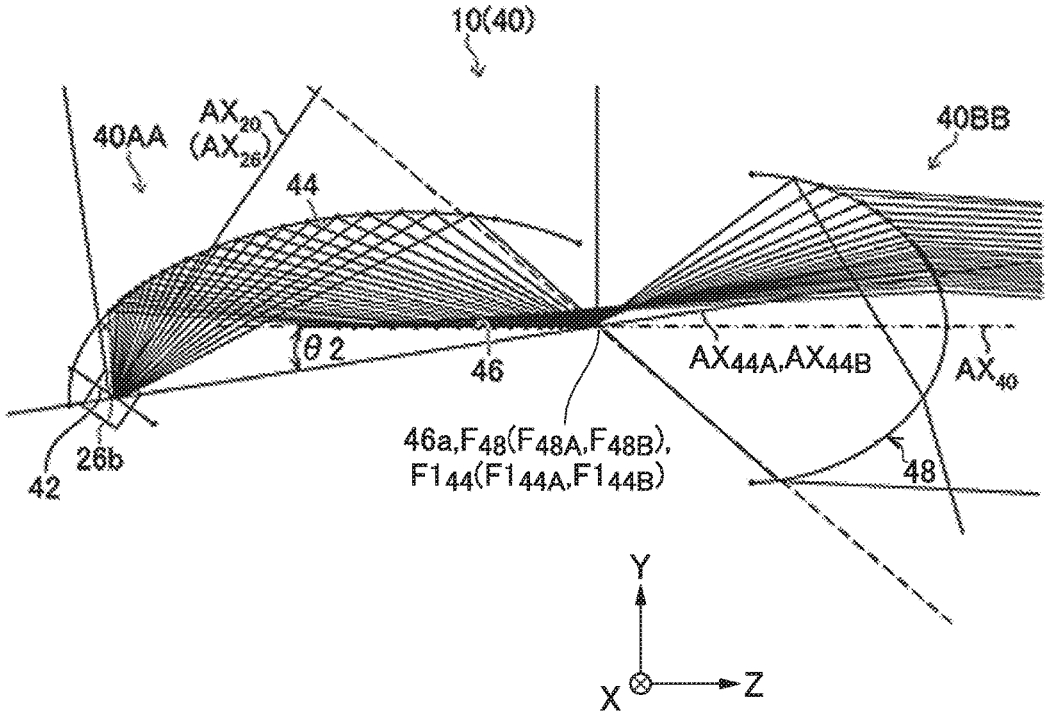
FIG. 7 is a cross-sectional schematic view of the lens body of the first embodiment, showing an optical path of light radiated from a front end point of the light source.
Figure 8:
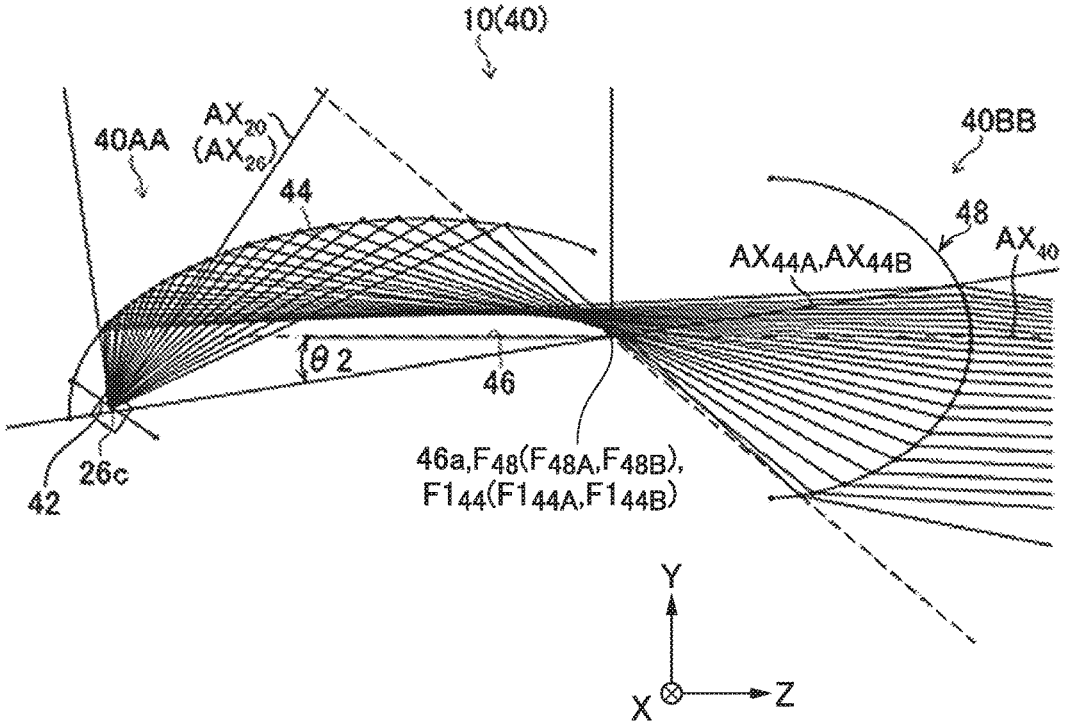
FIG. 8 is a cross-sectional schematic view of the lens body of the first embodiment, showing an optical path of light radiated from a rear end point of the light source.

FIG. 6 to FIG. 8 are cross-sectional schematic views of the lens body 40, FIG. 6 shows an optical path of light radiated from the light source central point 26*a*, FIG. 7 shows an optical path of light radiated from the light source front end point 26*b*, and FIG. 8 shows an optical path of light radiated from the light source rear end point 26*c*. Further, FIGS. 6 to 8 are schematic views of configurations of the lens body 40 but do not show cross-sectional shapes in actuality.

Further, as will be described below, the first reflecting surface 44 has the first reflective region 44A and the second reflective region 44B (see FIG. 9A and FIG. 9B). In addition, the first reflective region 44A and the second reflective region 44B have front focal points (a first front focal point $F1_{44A}$ and a second front focal point $F1_{44B}$) at different positions. In the following description, when a function common to the first front focal point $F1_{44A}$ and the second front focal point $F1_{44B}$ is described, the first front focal point $F1_{44A}$ and the second front focal point $F1_{44B}$ may be simply referred to as a front focal point $F1_{44}$.

Similarly, as described below, the light emitting surface 48 has a first leftward/rightward emission region 48A and a second leftward/rightward emission region 48B. In addition, the first leftward/rightward emission region 48A and the second leftward/rightward emission region 48B have light emitting surface focuses (a first light emitting surface focus $F_{48A}$ and a second light emitting surface focus $F_{48B}$) at different positions. In the following description, when a function shared by the first light emitting surface focus $F_{48A}$ and the second light emitting surface focus $F_{48B}$ is described, the first light emitting surface focus $F_{48A}$ and the second light emitting surface focus $F_{48B}$ may be simply referred to as a light emitting surface focus $F1_{48}$.

As shown in FIG. 6, the light radiated from the light source central point 26*a* is internally reflected by the first reflecting surface 44 and concentrated on the front focal point $F1_{44}$, and then, directed forward from the light emitting surface 48 to be emitted to be parallel to the forward/rearward reference axis $AX_{40}$.

As shown in FIG. 7, the light radiated from the light source front end point 26*b* is internally reflected by the first reflecting surface 44 and directed farther downward than the front focal point $F1_{44}$. Further, after the light is internally reflected upward by the second reflecting surface 46, the light is emitted forward and downward from the light emitting surface 48.

As shown in FIG. 8, the light radiated from the light source rear end point 26*c* is internally reflected by the first reflecting surface 44 and passes the upper side of the front focal point $F1_{44}$, and is emitted forward and downward from the light emitting surface 48.

<First Reflecting Surface>

The first reflecting surface 44 is a surface configured to internally reflect (totally reflect) the light from the light source 26 entering the lens body 40 from the incident surface 42.

Figure 9A:
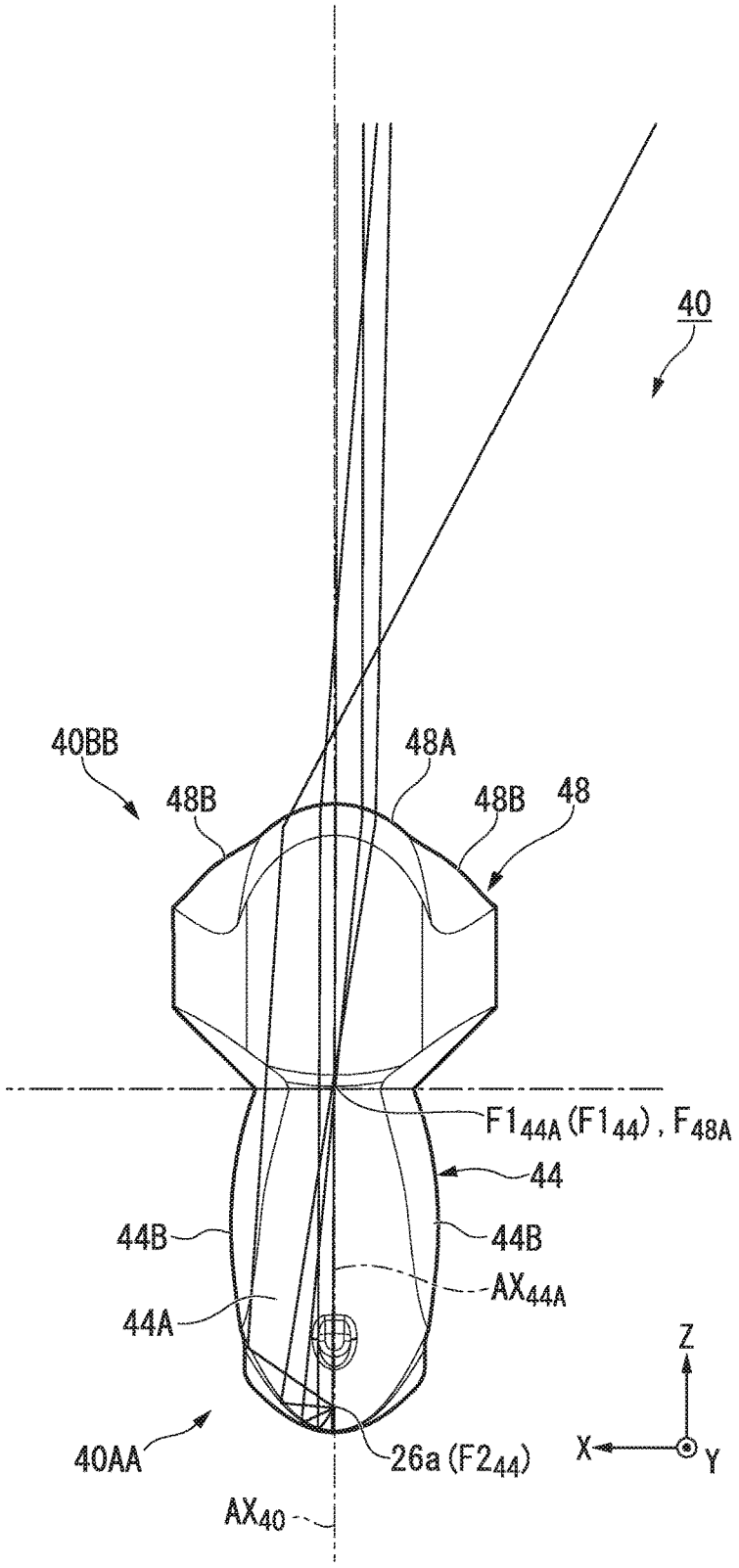
FIG. 9A is a plan view of the lens body of the first embodiment, showing an optical path of light reflected by a first reflective region.
Figure 9B:
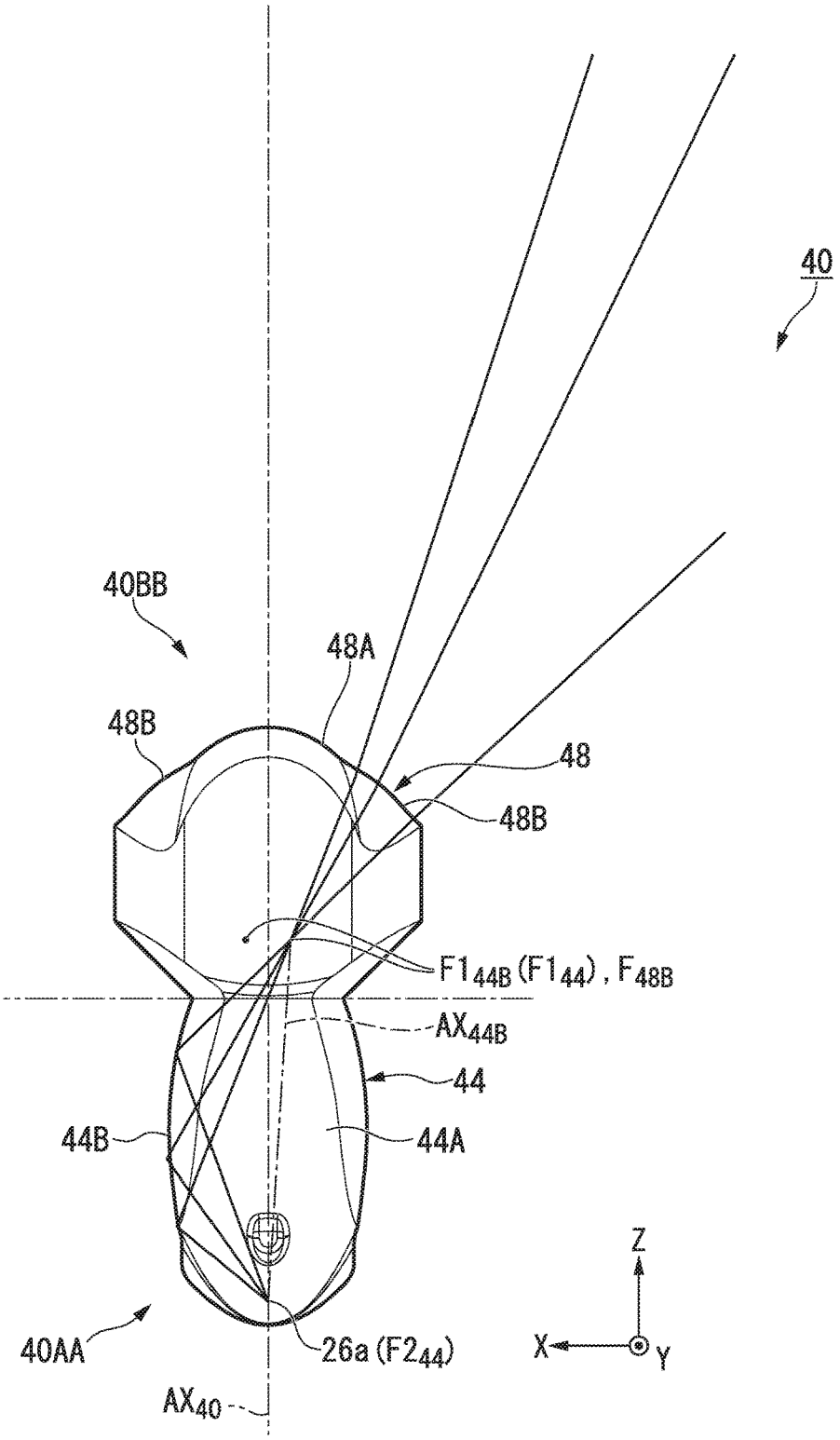
FIG. 9B is a plan view of the lens body of the first embodiment, showing an optical path of light reflected by a second reflective region.

FIG. 9A and FIG. 9B are plan views of the lens body 40, showing optical paths of light radiated from the light source central point 26*a*. FIG. 9A and FIG. 9B show optical paths of light radiated from the light source central point 26*a* in different directions.

The first reflecting surface 44 has the first reflective region 44A and the pair of second reflective regions 44B. The first reflective region 44A and the second reflective regions 44B are adjacent to each other in the leftward/rightward direction. The first reflective region 44A is disposed at a center of the first reflecting surface 44 when seen in the upward/ downward direction. In addition, the pair of second reflective regions 44B are disposed on both sides of the first reflective region 44A in the leftward/rightward direction, respectively. The first reflecting surface 44 constituted by the first reflective region 44A and the second reflective regions 44B has a shape in which a cross-sectional shape along a surface (an XZ plane) perpendicular to the upward/downward direction is symmetrical with respect to the forward/rearward reference axis $AX_{40}$.

As shown in FIG. 9A, the first reflective region 44A includes an elliptical spherical shape with reference to the first front focal point $F1_{44A}$ and a rear focal point $F2_{44}$ that are disposed in front of and to the rear thereof. That is, the first reflective region 44A includes an elliptical spherical shape that is rotationally symmetrical with respect to a first major axis $AX_{44A}$ through which the first front focal point $F1_{44A}$ and the rear focal point $F2_{44}$ pass.

As shown in FIG. 9B, the second reflective region 44B includes an elliptical spherical shape with reference to the second front focal point $F1_{44B}$ and the rear focal point $F2_{44}$ that are disposed in front of and to the rear thereof. That is, the second reflective region 44B includes an elliptical spherical shape that is rotationally symmetrical with respect to a second major axis $AX_{44B}$ through which the second front focal point $F1_{44B}$ and the rear focal point $F2_{44}$ pass.

The rear focal points $F2_{44}$ of the first reflective region 44A and the second reflective regions 44B coincide with each other. In addition, the rear focal point $F2_{44}$ is disposed in the vicinity of the light source (in particular, the light source central point 26*a*).

The front focal point $F1_{44}$ (i.e., the first front focal point $F1_{44A}$) of the first reflective region 44A overlaps the forward/rearward reference axis $AX_{40}$ when seen in the upward/downward direction. Accordingly, a major axis (the first major axis $AX_{44A}$) of an elliptical shape that constitutes the first reflective region 44A coincides with the forward/rearward reference axis $AX_{40}$ when seen in the upward/downward direction.

Meanwhile, the front focal point $F1_{44}$ (i.e., the second front focal point $F1_{44B}$) of the second reflective regions 44B is disposed such that it is shifted with respect to the forward/rearward reference axis $AX_{40}$ in the leftward/rightward direction when seen in the upward/downward direction. In addition, the second front focal point $F1_{44B}$ of the pair of second reflective regions 44B is disposed laterally symmetrically with respect to the forward/rearward reference axis $AX_{40}$. The second reflective regions 44B and the second front focal point $F1_{44B}$ of the second reflective regions 44B are disposed on opposite sides with the forward/rearward reference axis $AX_{40}$ sandwiched therebetween. Accordingly, an elliptical-shaped major axis (the second major axis $AX_{44B}$) that constitutes the second reflective region 44B is inclined from the forward/rearward reference axis $AX_{40}$ in the leftward/rightward direction when seen in the upward/downward direction.

As shown in FIG. 9A, the light passing through the rear focal point $F2_{44}$ and entering the first reflective region 44A among the light radiated from the imaginary light source position $F_v$ is concentrated on the first front focal point $F1_{44A}$. This is because the elliptical reflecting surface has a property of concentrating the light passing through one focus to another focus. The light concentrated on the first front focal point $F1_{44A}$ is emitted forward via the first leftward/rightward emission region 48A of the light emitting surface 48. The first front focal point $F1_{44A}$ is disposed in the vicinity of the first light emitting surface focus (a reference point) $F_{48A}$ of the first leftward/rightward emission region 48A. That is, the first reflective region 44A is configured to have a surface shape such that the light internally reflected from the light source central point 26*a* is concentrated on the vicinity of the first light emitting surface focus $F_{48A}$ of the first leftward/rightward emission region 48A.

As shown in FIG. 9B, the light passing through the rear focal point $F2_{44}$ and entering the second reflective regions 44B among the light radiated from the imaginary light source position $F_v$ is concentrated on the second front focal point $F1_{44B}$. The light concentrated on the second front focal point $F1_{44B}$ is emitted forward via the second leftward/rightward emission region 48B of the light emitting surface 48. The second front focal point $F1_{44B}$ is disposed in the vicinity of the second light emitting surface focus (a reference point) $F_{48B}$ of the second leftward/rightward emission region 48B. That is, the second reflective regions 44B is configured to have a surface shape such that the light internally reflected from the light source central point 26*a* is concentrated on the vicinity of the second light emitting surface focus $F_{48B}$ of the second leftward/rightward emission region 48B.

According to the embodiment, the rear focal point $F2_{44}$ is disposed in the vicinity of the imaginary light source position $F_v$. Meanwhile, the front focal point $F1_{44}$ (i.e., the first front focal point $F1_{44A}$) of the first reflective region 44A and the front focal point $F1_{44}$ (i.e., the second front focal point $F1_{44B}$) of the second reflective region 44B are disposed at different positions when seen in the upward/downward direction.

A distance between the first front focal point $F1_{44A}$ and the rear focal point $F2_{44}$ of the first reflective region 44A and an eccentricity are determined such that the light internally reflected by the first reflective region 44A is captured by the light emitting surface 48 (in particular, the first leftward/rightward emission region 48A). Similarly, a distance between the second front focal point $F1_{44B}$ and the rear focal point $F2_{44}$ of the second reflective regions 44B and an eccentricity are determined such that the light internally reflected by the second reflective regions 44B is captured by the light emitting surface 48 (in particular, the second leftward/rightward emission region 48B). Accordingly, since a larger amount of light can be captured by the light emitting surface 48, light utilization efficiency is improved.

As shown in FIG. 6, the first major axis $AX_{44A}$ and the second major axis $AX_{44B}$ are inclined together at an angle θ2 with respect to the forward/rearward reference axis $AX_{40}$. The first major axis $AX_{44A}$ is inclined upward as it goes forward such that the rear focal point $F2_{44}$ is disposed below the first front focal point $F1_{44A}$. Similarly, the second major axis $AX_{44B}$ is inclined upward as it goes forward such that the rear focal point $F2_{44}$ is disposed below the second front focal point $F1_{44B}$. As the first major axis $AX_{44A}$ and the second major axis $AX_{44B}$ are inclined while the rear focal point $F2_{44}$ side is directed downward, an angle of the light internally reflected by the second reflecting surface 46 with respect to the forward/rearward reference axis $AX_{40}$ becomes shallow. Accordingly, the light radiated from the light source front end point 26*b* and internally reflected by the first reflecting surface 44 and the second reflecting surface 46 is easily captured by the light emitting surface 48. Accordingly, in comparison with the case in which the first major axis $AX_{44A}$ and the second major axis $AX_{44B}$ are not inclined with respect to the forward/rearward reference axis $AX_{40}$ (i.e., in the case of the angle θ2=0°), the size of the light emitting surface 48 can be reduced, and a larger amount of light can be captured by the light emitting surface 48. In addition, as the first major axis $AX_{44A}$ and the second major axis $AX_{44B}$ are inclined while the rear focal point $F2_{44}$ side is directed downward, an incident angle of the light entering the first reflecting surface 44 from the light source 26 easily becomes a critical angle or more. Accordingly, the light from the light source 26 is easily totally reflected by the first reflecting surface 44, and utilization efficiency of the light can be increased.

Further, here, the case in which the angles θ2 of the first major axis $AX_{44A}$ and the second major axis $AX_{44B}$ with respect to the forward/rearward reference axis $AX_{40}$ coincide with each other has been described. However, the angles θ2 of the first major axis $AX_{44A}$ and the second major axis $AX_{44B}$ with respect to the forward/rearward reference axis $AX_{40}$ may be different angles as long as the angles have the above-mentioned configuration.

<Second Reflecting Surface>

As shown in FIG. 7, the second reflecting surface 46 is a surface configured to internally reflect (totally reflect) at least some of the light from the light source 26 internally reflected by the first reflecting surface 44. The second reflecting surface 46 is configured as a reflecting surface extending rearward from the vicinity of the front focal point $F1_{44}$. That is, the front focal point $F1_{44}$ is substantially disposed in an extension surface of the second reflecting surface 46. In the embodiment, the second reflecting surface 46 has a plane shape extending in parallel to the forward/rearward reference axis $AX_{40}$.

The second reflecting surface 46 reflects the light that is to pass below the front focal point $F1_{44}$, among the light internally reflected by the first reflecting surface 44, upward. When the light that is to pass below the front focal point $F1_{44}$ enters the light emitting surface 48 without being reflected by the second reflecting surface 46, the light is emitted as the light directed upward from the light emitting surface 48. Since the second reflecting surface 46 is formed, an optical path of such light is inverted and the light can be emitted as the light directed downward by entering above the light emitting surface 48. That is, the lens body 40 can invert the optical path of the light to be directed upward from the light emitting surface 48 by forming the second reflecting surface 46, and can form a light distribution pattern including the cutoff line CL at the upper edge. A front edge 46*a* of the second reflecting surface 46 includes an edge shape configured to shield some of the light from the light source 26 internally reflected by the first reflecting surface 44 and form the cutoff line CL of the low beam light distribution pattern P. The front edge 46*a* of the second reflecting surface 46 is disposed in the vicinity of the front focal point $F1_{44}$.

Further, the positional relation between the front focal point $F1_{44}$ and the front edge 46*a* described herein may satisfy any one or both of the first front focal point $F1_{44A}$ of the first reflective region 44A and the second front focal point $F1_{44B}$ of the second reflective regions 44B. However, when both of the first front focal point $F1_{44A}$ and the second front focal point $F1_{44B}$ are satisfied, the cutoff line CL can be more clearly formed.

Figure 10A:
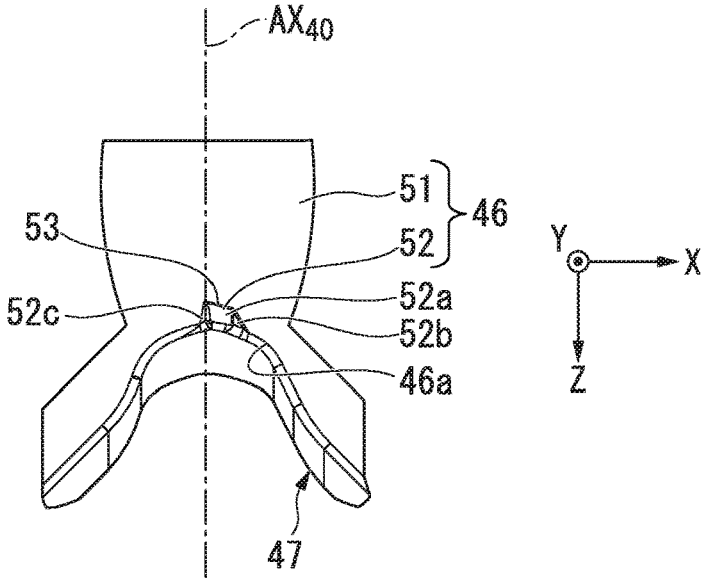
FIG. 10A is a plan view of a second reflecting surface and an inclined surface of the lens body of the first embodiment.
Figure 10B:
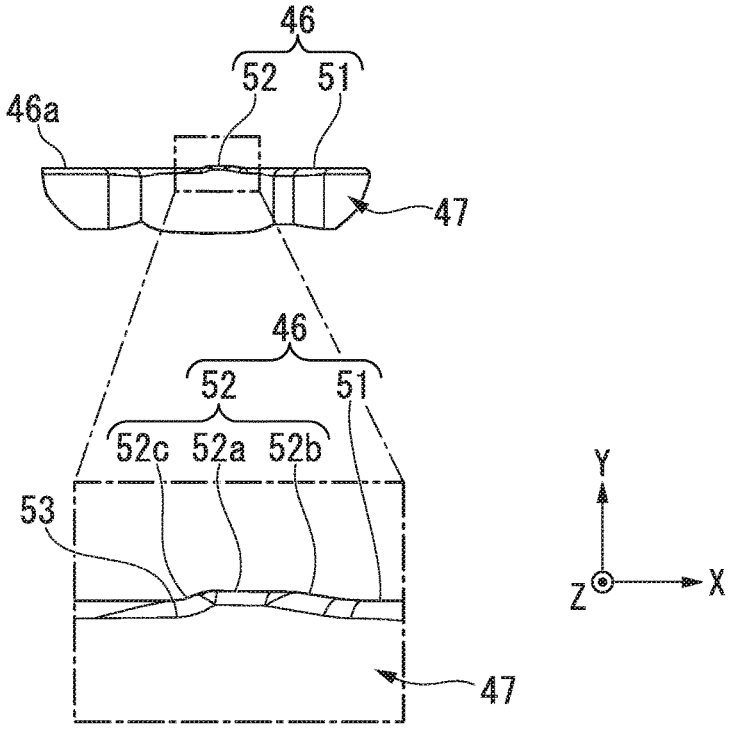
FIG. 10B is a front view of an inclined surface in the lens body of the first embodiment.
Figure 10C:
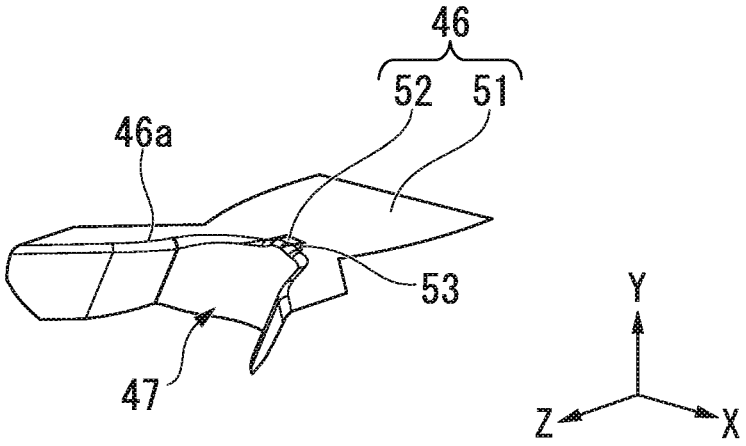
FIG. 10C is a perspective view of the second reflecting surface and the inclined surface in the lens body of the first embodiment.

FIG. 10A is a plan view of the second reflecting surface 46 and an inclined surface 47. FIG. 10B is a front view of the inclined surface 47. FIG. 10C is a perspective view of the second reflecting surface 46 and the inclined surface 47. Further, in FIG. 10A to FIG. 10C, in order to emphasize the second reflecting surface 46 and the inclined surface 47, illustration of other surfaces that constitutes the lens body 40 will be omitted.

As shown in FIG. 10A, the front edge 46*a* of the second reflecting surface 46 extends forward from the central section thereof so that a portion positioned more outer side in the leftward/rightward direction is positioned more forward. Accordingly, the front edge 46*a* is formed in a V shape when seen in the upward/downward direction. As described above, the front edge 46*a* includes an edge shape that forms the cutoff line CL. As the front edge 46*a* extends forward from the central section thereof so that a portion positioned more outer side in the leftward/rightward direction is positioned more forward, the front edge 46*a* can coincide with a boundary between a pattern of the light partially shielded by the front edge 46*a* of the second reflecting surface 46 and emitted from the light emitting surface 48 and a pattern of the light reflected by the second reflecting surface 46 and emitted from the light emitting surface 48. Accordingly, the cutoff line CL can be more clearly formed.

As shown in FIG. 10B, the second reflecting surface 46 has a main surface section 51, and a subsidiary surface section 52 shifted upward from the main surface section 51. The main surface section 51 is formed to be flat. Meanwhile, the subsidiary surface section 52 protrudes upward with respect to the main surface section 51. The subsidiary surface section 52 extends toward the rear side from substantially a center of the front edge 46*a* of the second reflecting surface 46. At least a portion of a boundary section 53 between the subsidiary surface section 52 and the main surface section 51 extends rearward from the front edge 46*a* of the second reflecting surface 46. Accordingly, the front edge 46*a* vertically forms a step difference in the boundary section 53. Accordingly, the step difference in the upward/downward direction is formed on the cutoff line CL.

The subsidiary surface section 52 has a subsidiary surface central section 52*a*, and a subsidiary surface left portion 52*b* and a subsidiary surface right portion 52*c* that are disposed at both of left and right sides of the subsidiary surface central section 52*a*, respectively. The main surface section 51 is disposed behind the subsidiary surface central section 52*a*, the subsidiary surface left portion 52*b* and the subsidiary surface right portion 52*c* with the boundary section 53 therebetween. In addition, the inclined surface 47 is disposed in front of the subsidiary surface central section 52*a*, the subsidiary surface left portion 52*b* and the subsidiary surface right portion 52*c* via the front edge 46*a*. A boundary between the subsidiary surface central section 52*a* and the subsidiary surface right portion 52*c* is disposed at substantially a center in the leftward/rightward direction.

Further, in the embodiment, a portion shifted upward from the main surface section 51 is the subsidiary surface section 52. However, when the main surface section 51 and the subsidiary surface section 52 are shifted from each other in the upward/downward direction, any one of them may be disposed on upper side. In addition, in the embodiment, the case in which the second reflecting surface 46 has one subsidiary surface section 52 has been described. However, the second reflecting surface 46 may have two or more subsidiary surface sections 52.

Returning to FIG. 7, an inclination angle of the second reflecting surface 46 with respect to the forward/rearward reference axis $AX_{40}$ will be described. The second reflecting surface 46 may be parallel to or inclined with respect to the forward/rearward reference axis $AX_{40}$. Here, an angle of the second reflecting surface 46 with respect to the forward/rearward reference axis $AX_{40}$ will be described as an angle θ3 (not shown). Further, in the embodiment, the angle θ3=0°.

The angle θ3 of the second reflecting surface 46 with respect to the forward/rearward reference axis $AX_{40}$ is preferably determined such that the light entering the second reflecting surface 46 among the light from the light source 26 internally reflected by the first reflecting surface 44 is internally reflected by the second reflecting surface 46 and the reflected light is efficiently taken into the light emitting surface 48. Accordingly, since a larger amount of light can be captured by the light emitting surface 48, light utilization efficiency is improved. That is, the angle θ3 of the second reflecting surface 46 with respect to the forward/rearward reference axis $AX_{40}$ is preferable to be set to an angle in which the light internally reflected by the second reflecting surface 46 is sufficiently captured by the light emitting surface 48.

In addition, the angle θ3 of the second reflecting surface 46 with respect to the forward/rearward reference axis $AX_{40}$ is preferable to be set to an angle at which the light that is internally reflected by the first reflecting surface 44 and that reaches the light emitting surface 48 without being internally reflected by the second reflecting surface 46 is not shielded.

In the embodiment, in consideration of the above-mentioned description, the angle θ3=0° is employed.

<Light Emitting Surface>

As shown in FIG. 4, the light emitting surface 48 is a lens surface protruding forward. The light emitting surface 48 emits the light internally reflected by the first reflecting surface 44 and the light internally reflected by the first reflecting surface 44 and the second reflecting surface 46 forward. In addition, the light emitting surface 48 has a convex shape in a cross section along a surface perpendicular to the leftward/rightward direction of the vehicle, and the light emitting surface 48 has an optical axis parallel to the forward/rearward reference axis $AX_{40}$.

As shown in FIG. 9A and FIG. 9B, the light emitting surface 48 has the first leftward/rightward emission region 48A and the pair of second leftward/rightward emission regions 48B in a cross section along a surface (an XZ plane) perpendicular to the upward/downward direction. The first leftward/rightward emission region 48A and the second leftward/rightward emission regions 48B are adjacent to each other in the leftward/rightward direction. The first leftward/rightward emission region 48A is disposed at a center of the light emitting surface 48 when seen in the upward/downward direction. In addition, the pair of second leftward/rightward emission regions 48B are disposed at both sides of the first leftward/rightward emission region 48A in the leftward/rightward direction, respectively. The light emitting surface 48 constituted by the first leftward/rightward emission region 48A and the second leftward/rightward emission regions 48B has a shape in which a cross-sectional shape along the surface (the XZ plane) perpendicular to the upward/downward direction is laterally symmetrical with respect to the forward/rearward reference axis $AX_{40}$.

As shown in FIG. 9A, the forward/rearward reference axis $AX_{40}$ passes through the first leftward/rightward emission region 48A. The first leftward/rightward emission region 48A constitutes a convex shape (a convex lens shape) when seen in the upward/downward direction. The light reflected by the first reflective region 44A of the first reflecting surface 44 passes through the first leftward/rightward emission region 48A. The first leftward/rightward emission region 48A refracts the light passing through and entering the first front focal point $F1_{44A}$ in a direction in which the light approaches the forward/rearward reference axis $AX_{40}$ when seen in the upward/downward direction.

As shown in FIG. 9B, the second leftward/rightward emission regions 48B constitute a convex shape (a convex lens shape) when seen in the upward/downward direction. The light reflected by the second reflective regions 44B of the first reflecting surface 44 passes through the second leftward/rightward emission regions 48B. The second leftward/rightward emission regions 48B refracts the entered light by passing through the second front focal point $F1_{44B}$ in a direction in which the light gets away from the forward/rearward reference axis $AX_{40}$ when seen in the upward/downward direction.

Next, an optical path of the light passing through the first leftward/rightward emission region 48A and the second leftward/rightward emission regions 48B in a cross section perpendicular to the leftward/rightward direction will be described with reference to FIG. 4.

The first leftward/rightward emission region 48A has a convex shape in which a point disposed in the vicinity of the first front focal point $F1_{44A}$ is set as a first reference point $F_{48A}$ in a cross section perpendicular to the leftward/rightward direction.

Similarly, the second leftward/rightward emission regions 48B have a convex shape in which a point disposed in the vicinity of the second front focal point $F1_{44B}$ is set as a second reference point $F_{48B}$ in a cross section perpendicular to the leftward/rightward direction.

Here, a reference point is referred to as a point disposed at a center in a condensing region in which light is concentrated in front of the light emitting surface 48 when the light emitted from the light emitting surface 48 forms a desired light distribution pattern. In the specification, the first leftward/rightward emission region 48A and the second leftward/rightward emission regions 48B do not have a cross section with a strictly uniform radius of curvature in the upward/downward direction. Accordingly, while the first leftward/rightward emission region 48A and the second leftward/rightward emission regions 48B do not have a strict focus, the reference point (the first reference point $F_{48A}$ and the second reference point $F_{48B}$) to which the light is concentrated can be regarded as a focus. In the specification, the reference points (the first reference point $F_{48A}$ and the second reference point $F_{48B}$) of the first leftward/rightward emission region 48A and the second leftward/rightward emission regions 48B are referred to as the light emitting surface focus ((the first light emitting surface focus $F_{48A}$ and the second light emitting surface focus $F_{48B}$)).

The first leftward/rightward emission region 48A is formed such that the point disposed in the vicinity of the first front focal point $F1_{44A}$ becomes the first light emitting surface focus $F_{48A}$. Accordingly, the lights of the plurality of optical paths internally reflected by the first reflective region 44A and concentrated on the first front focal point $F1_{44A}$ are emitted substantially parallel to each other at least in the vertical direction as the light enters the first leftward/rightward emission region 48A.

Similarly, the second leftward/rightward emission regions 48B are formed such that the point disposed in the vicinity of the second front focal point $F1_{44B}$ becomes the second light emitting surface focus $F_{48B}$. Accordingly, the lights of the plurality of optical paths internally reflected by the second reflective regions 44B and concentrated on the second front focal point $F1_{44B}$ are emitted substantially parallel to each other in at least the vertical direction as the light enters the second leftward/rightward emission regions 48B.

When seen in the leftward/rightward direction, the first leftward/rightward emission region 48A and the second leftward/rightward emission regions 48B have the optical axes L that coincide with each other and coincide with the forward/rearward reference axis $AX_{40}$. In addition, the optical axes L of the first leftward/rightward emission region 48A and the second leftward/rightward emission regions 48B may not coincide with each other as long as the optical axes L are parallel to the forward/rearward reference axis $AX_{40}$. Accordingly, the light passing through the first light emitting surface focus $F_{48A}$ and entering the first leftward/rightward emission region 48A and the light passing through the second light emitting surface focus $F_{48B}$ and entering the second leftward/rightward emission regions 48B are emitted parallel to the forward/rearward reference axis $AX_{40}$ at least in the vertical direction. That is, the light emitting surface 48 is configured to have a surface such that the light passing through the vicinity of the front focal point $F1_{44}$ (the first front focal point $F1_{44A}$ and the second front focal point $F1_{44B}$) is emitted in a direction substantially parallel to the forward/rearward reference axis $AX_{40}$ at least in the vertical direction. In other words, a surface shape of the light emitting surface 48 is formed such that an elevation angle of the light emitted from the light emitting surface 48 is substantially parallel to an elevation angle of the forward/rearward reference axis $AX_{40}$.

Further, an emission direction in the XZ plane (i.e., the leftward/rightward direction) of the light emitted from the light emitting surface 48 may be a direction different from the forward/rearward reference axis $AX_{40}$.

As shown in FIG. 9A and FIG. 9B, the first leftward/rightward emission region 48A and the second leftward/rightward emission regions 48B of the embodiment emit the light passing through and entering the front focal points $F1_{44}$ (the first front focal point $F1_{44A}$ and the second front focal point $F1_{44B}$) in left and right different directions.

For this reason, the lens body 40 of the embodiment can illuminate a lateral wide area.

The light emitting surface 48 has the first leftward/rightward emission region 48A, and the pair of second leftward/rightward emission regions 48B disposed at both sides of the first leftward/rightward emission region 48A in the leftward/rightward direction. Accordingly, the first leftward/rightward emission region 48A can irradiate a central region of a front side with light, and the pair of second leftward/rightward emission regions 48B can radiate both side regions in the leftward/rightward direction with light.

Accordingly, according to the lens body 40 of the embodiment, a light distribution pattern that is wide at both of left and right sides with respect to the forward/rearward reference axis $AX_{40}$ can be realized. Further, as the first leftward/rightward emission region 48A and the pair of second leftward/rightward emission regions 48B are disposed laterally symmetrically with respect to the forward/rearward reference axis $AX_{40}$, a light distribution pattern laterally symmetrical with respect to the forward/rearward reference axis $AX_{40}$ can be formed.

According to the embodiment, the light reflected by the first reflective region 44A enters the first leftward/rightward emission region 48A, and the light reflected by the second reflective regions 44B enters the second leftward/rightward emission regions 48B. That is, the regions formed on the first reflecting surface 44 and the light emitting surface 48 reflect or refract the light corresponding thereto. For this reason, as surface shapes of the regions of the light emitting surface 48 in the cross section perpendicular to the upward/downward direction are set according to front focal points of the regions of the first reflecting surface 44, the optical paths of the light emitted from the regions of the light emitting surface 48 can be easily controlled.

In the embodiment, the light passing through the second front focal point $F1_{44B}$ of one (a left side in FIG. 9B) of the pair of second reflective regions 44B is emitted forward via the second leftward/rightward emission regions 48B of one (a right side in FIG. 9B) of the pair of second leftward/rightward emission regions 48B. Similarly, the light passing the second front focal point $F1_{44B}$ of the other (a right side in FIG. 9B) of the pair of second reflective regions 44B is emitted forward via the second leftward/rightward emission regions 48B of the other (a left side in FIG. 9B) of the pair of second leftward/rightward emission regions 48B. According to the embodiment, as the pair of second reflective regions 44B and the pair of second leftward/rightward emission regions 48B are formed, the light radially spread about the optical axis of the light source 26 can be effectively used for light distribution in the leftward/rightward direction.

According to the embodiment, the light within a predetermined angular range with respect to the optical axis $AX_{26}$ of the light source 26 among the light from the light source 26 is refracted on the incident surface 42 in a direction in which the light is concentrated, and enters the lens body. Accordingly, the incident angle of the light within the predetermined angular range with respect to the first reflecting surface 44 can be set to a critical angle or more. Further, as the optical axis $AX_{26}$ of the light source 26 is inclined with respect to the vertical axis V, the incident angle of the light, that is from the light source 26 and that has entered the lens body 40, with respect to the first reflecting surface 44 becomes the critical angle or more. That is, the light from the light source 26 can enter the first reflecting surface 44 at the incident angle of the critical angle or more. Accordingly, reduction in costs can be achieved without necessity of metal deposition on the first reflecting surface 44, and reflection loss generated on a deposition surface can be minimized to increase utilization efficiency of light.

Hereinabove, while the embodiment of the present invention has been described, the configurations, combinations thereof, and so on, of the embodiment are exemplary, and additions, omissions, substitutions and other modifications may be made without departing from the scope of the present invention. In addition, the present invention is not limited to the embodiment.

For example, in the above-mentioned embodiment, the example in which the present invention is applied to the lens body 40 configured to form the low beam light distribution pattern P (see FIG. 13) has been described. However, for example, the embodiment may be applied to a lens body configured to form a fog lamp light distribution pattern, a lens body configured to form a high beam light distribution pattern, or other lens bodies.

In addition, while a major axis $AX_{44}$ of the first reflecting surface 44 is inclined with respect to the forward/rearward reference axis $AX_{40}$ at the angle θ2 in the above-mentioned embodiment, there is no limitation thereto and the major axis $AX_{44}$ (the major axis) of the first reflecting surface 44 may not be inclined with respect to the forward/rearward reference axis $AX_{40}$ (i.e., the angle θ2=0° may be possible).

Even in this case, as a size of the light emitting surface 48 is increased, the light from the light source 26 internally reflected by the first reflecting surface 44 can be effectively taken into the light emitting surface 48.

In addition, in the embodiment, when the first leftward/rightward emission region 48A and the second leftward/rightward emission regions 48B are disposed adjacent to each other in the leftward/rightward direction, there is no limitation to the disposition. For example, the first leftward/rightward emission region 48A and the second leftward/ rightward emission regions 48B may have a positional relationship that is the inverse of that of the above-mentioned embodiment.

Second Embodiment

Next, a lens body 140 of a second embodiment will be described. The lens body 140 of the second embodiment has different configurations of, mainly, a first reflecting surface 144 and a light emitting surface 148 from those of the first embodiment. Further, the components of the same aspect as the above-mentioned embodiment are designated by the same reference numerals and description thereof will be omitted.

Figure 11A:
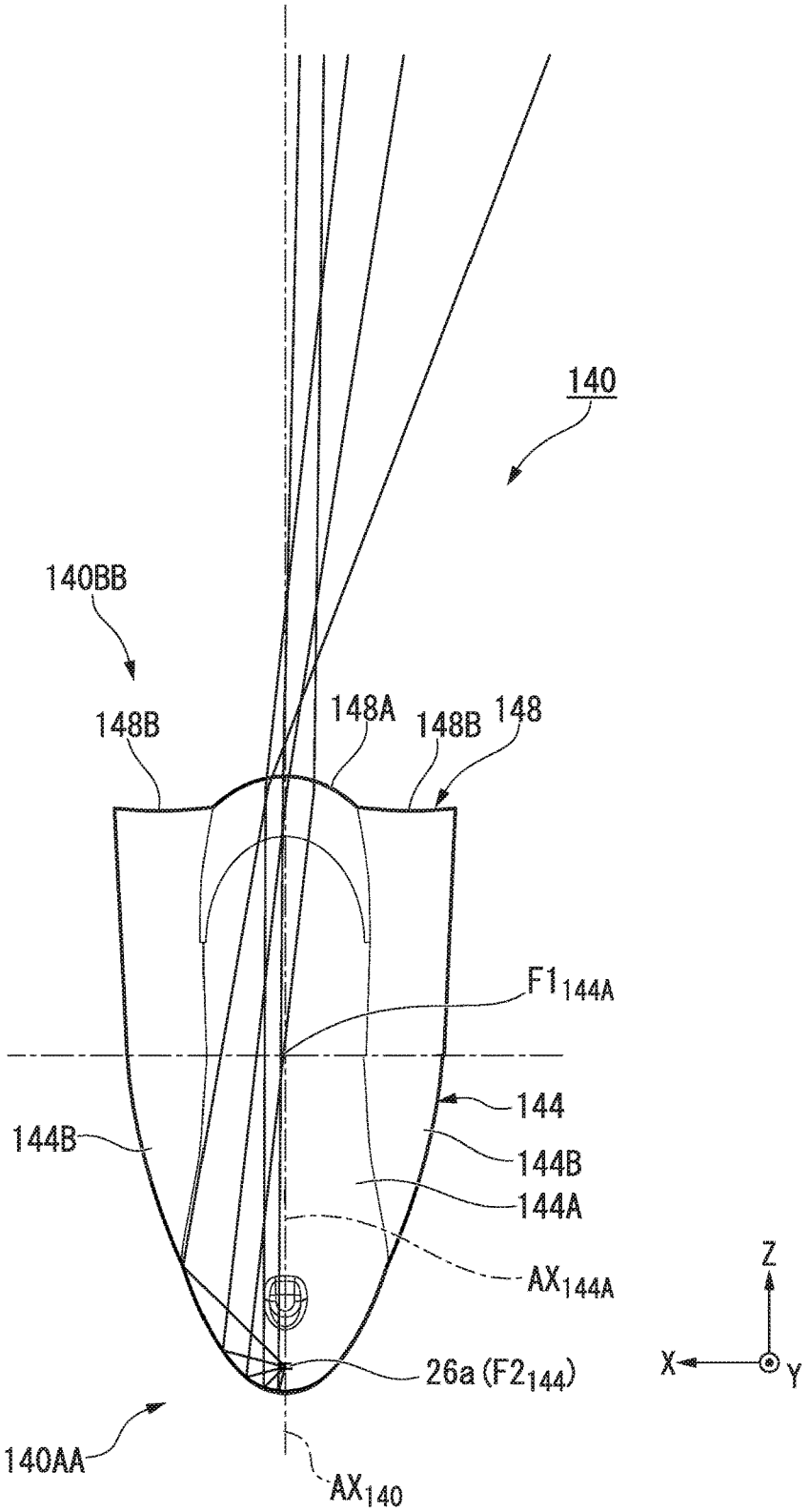
FIG. 11A is a plan view of a lens body of a second embodiment, showing an optical path of light reflected by a first reflective region.
Figure 11B:
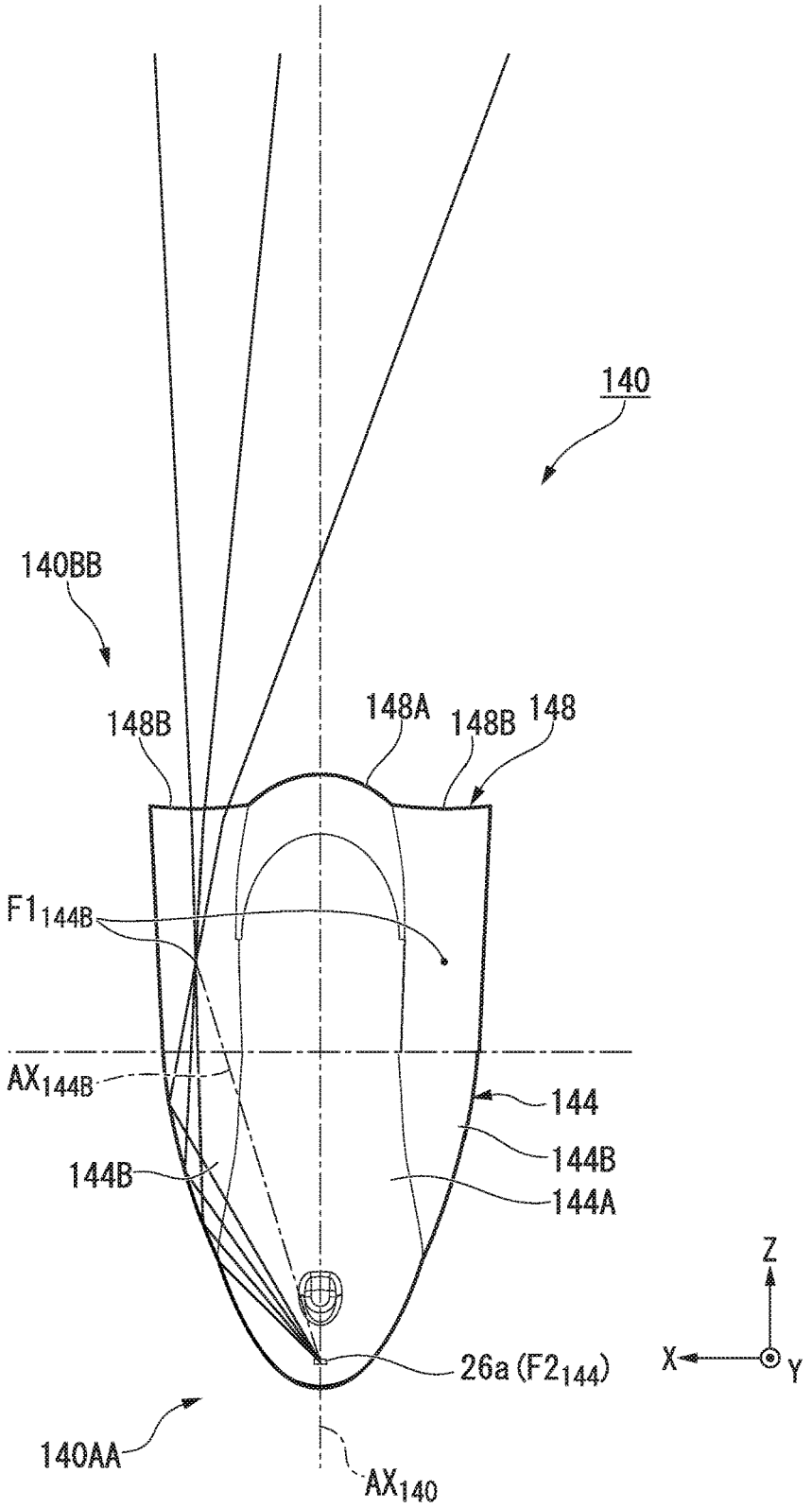
FIG. 11B is a plan view of the lens body of the second embodiment, showing an optical path of light reflected by a second reflective region.

FIG. 11A and FIG. 11B are plan views of the lens body 140, showing optical paths of light radiated from the light source central point 26*a*. FIG. 11A and FIG. 11B show optical paths of light radiated from the light source central points 26*a* in different directions, respectively.

The lens body 140 is a solid multi-face lens body having a shape extending along the forward/rearward reference axis $AX_{140}$. Further, in the embodiment, the forward/rearward reference axis $AX_{140}$ is an axis extending in the forward/rearward direction (the Z-axis direction) of the vehicle and serving as a reference passing through a center of the light emitting surface 148 of the lens body 140, which will be described below. The lens body 140 is disposed in front of the light source (not shown). The lens body 140 includes a rear end portion 140AA directed rearward, and a front end portion 140BB directed forward.

The lens body 140 has the first reflecting surface 144 and the light emitting surface 148, and the incident surface (the incidence part) 42 and the second reflecting surface 46 that have the same configuration as the first embodiment and not shown in FIG. 11A and FIG. 11B. The first reflecting surface 144 has a first reflective region 144A and a pair of second reflective regions 144B. The light emitting surface 148 has a first leftward/rightward emission region 148A and a pair of second leftward/rightward emission regions 148B. The forward/rearward reference axis $AX_{140}$ passes through the first leftward/rightward emission region 148A. The second leftward/rightward emission regions 148B are adjacent to the first leftward/rightward emission region 148A in the leftward/rightward direction.

The first reflective region 144A and the second reflective regions 144B are adjacent to each other in the leftward/rightward direction. The first reflective region 144A is disposed at a center of the first reflecting surface 144 when seen in the upward/downward direction. In addition, the pair of second reflective regions 144B are disposed at both sides of the first reflective region 144A in the leftward/rightward direction, respectively. The first reflecting surface 144 constituted by the first reflective region 144A and the second reflective regions 144B has a shape in which a cross-sectional shape along a surface (an XZ plane) perpendicular to the upward/downward direction is laterally symmetrical with respect to the forward/rearward reference axis $AX_{140}$.

As shown in FIG. 11A, the first reflective region 144A includes an elliptical spherical shape with reference to the first front focal point $F1_{144A}$ and the rear focal point $F2_{144}$ that are disposed parallel with each other in forward/rearward direction. That is, first reflective region 144A includes an elliptical spherical shape rotationally symmetrical to the first major axis $AX_{144A}$ through which the first front focal point $F1_{144A}$ and the rear focal point $F2_{144}$ pass.

Further, while the first reflective region 144A has an elliptical spherical shape in a region close to the forward/rearward reference axis $AX_{140}$ when seen in the upward/downward direction, the first reflective region 144A has a shape getting away from the elliptical spherical shape as it is separated from the forward/rearward reference axis $AX_{140}$ in the embodiment.

As shown in FIG. 11B, the second reflective regions 144B include an elliptical spherical shape with reference to the second front focal point $F1_{144B}$ and the rear focal point $F2_{144}$ that are disposed parallel with each other in forward/rearward direction. That is, the second reflective regions 144B include an elliptical spherical shape that is rotationally symmetrical to the second major axis $AX_{144B}$ through which the second front focal point $F1_{144B}$ and the rear focal point $F2_{144}$ pass.

The rear focal points $F2_{144}$ of the first reflective region 144A and the second reflective regions 144B coincide with each other. In addition, the rear focal point $F2_{144}$ is disposed in the vicinity of the light source central point 26*a*.

The first front focal point $F1_{144A}$ of the first reflective region 144A overlaps the forward/rearward reference axis $AX_{140}$ when seen in the upward/downward direction. Accordingly, the major axis (the first major axis $AX_{144A}$) of the elliptical shape that constitutes the first reflective region 144A coincides with the forward/rearward reference axis $AX_{140}$ when seen in the upward/downward direction.

Meanwhile, the second front focal point $F1_{144B}$ of the second reflective regions 144B is disposed such that it is shifted from the forward/rearward reference axis $AX_{140}$ in the leftward/rightward direction when seen in the upward/downward direction. In addition, the second front focal point $F1_{144B}$ of the pair of second reflective regions 144B is disposed to be laterally symmetrical to the forward/rearward reference axis $AX_{140}$. The second reflective regions 144B and the second front focal point $F1_{144B}$ of the second reflective regions 144B are disposed at the same side as the forward/rearward reference axis $AX_{140}$ when seen in the upward/downward direction. Accordingly, the major axis (the second major axis $AX_{144B}$) of the elliptical shape that constitutes the second reflective region 144B is inclined from the forward/rearward reference axis $AX_{140}$ in the leftward/rightward direction when seen in the upward/downward direction.

As shown in FIG. 11A, the light passed through the rear focal point $F2_{144}$ and entered the first reflective region 144A is concentrated on the first front focal point $F1_{144A}$, and emitted forward via the first leftward/rightward emission region 148A of the light emitting surface 148. The first leftward/rightward emission region 148A refracts the entered light passed through the first front focal point $F1_{144A}$ in a direction approaching the forward/rearward reference axis $AX_{140}$ when seen in the upward/downward direction.

As shown in FIG. 11B, the light passed through the rear focal point $F2_{144}$ and entered the second reflective regions 144B is concentrated on the second front focal point $F1_{144B}$, and emitted forward via the second leftward/rightward emission regions 148B of the light emitting surface 148. The second leftward/rightward emission regions 148B refracts some of the entered light passed through the second front focal point $F1_{144B}$ in a direction getting away from the forward/rearward reference axis $AX_{140}$ when seen in the upward/downward direction.

According to the embodiment, the first leftward/rightward emission region 148A of the embodiment concentrates the entered light passed through the first front focal point $F1_{144A}$ toward a central portion and the second leftward/rightward emission regions 148B diffuse and emit some of the entered light passed through the second front focal point $F1_{144B}$ in the leftward/rightward direction. For this reason, the lens body 140 of the embodiment can illuminate left and right sides widely while brightening the central side.

A direction in which the second major axis $AX_{144B}$ of the second reflective regions 144B is inclined with respect to the first major axis $AX_{144A}$ of the first reflective region 144A in the lens body 140 of the embodiment is opposite to that of the first embodiment. Even in the above-mentioned configuration, the same effect as the above-mentioned embodiment can be exhibited.

Further, while the example in which the front focal points of the first reflective regions 44A and 144A and the second reflective regions 44B and 144B are shifted in the leftward/rightward direction has been described in the first embodiment and the second embodiment, the front focal points may be shifted in the forward/rearward direction.

EXAMPLE

Hereinafter, an example makes the effect of the present invention more apparent. Further, the present invention is not limited to the following example and may be appropriately modified without departing from the scope of the present invention.

<Light Distribution Pattern Corresponding to First Embodiment>

A simulation of a light distribution pattern with respect to an imaginary vertical screen confronting the lens body 40 in front of the lens body 40 has been performed on the lighting tool 10 for a vehicle of the above-mentioned first embodiment.

Figure 12A:
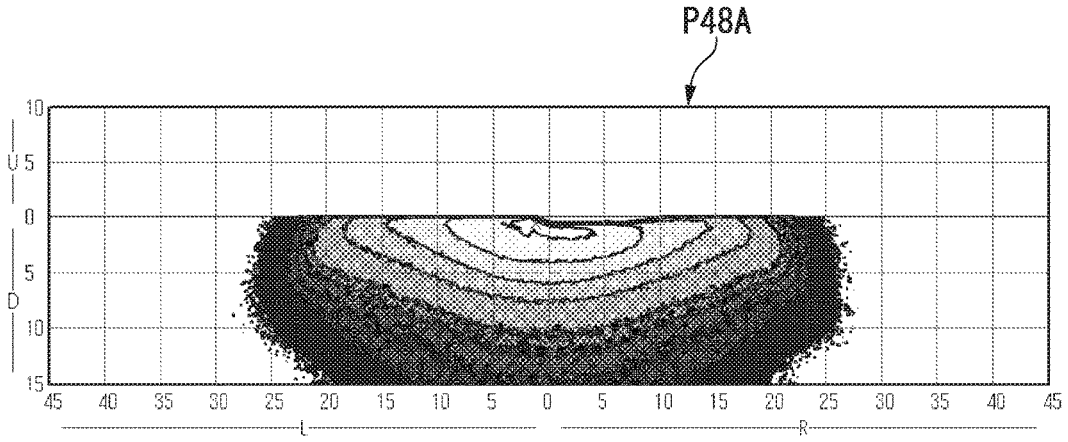
FIG. 12A shows a light distribution pattern of light radiated from different regions of a light emitting surface of the lens body of the first embodiment.
Figure 12B:
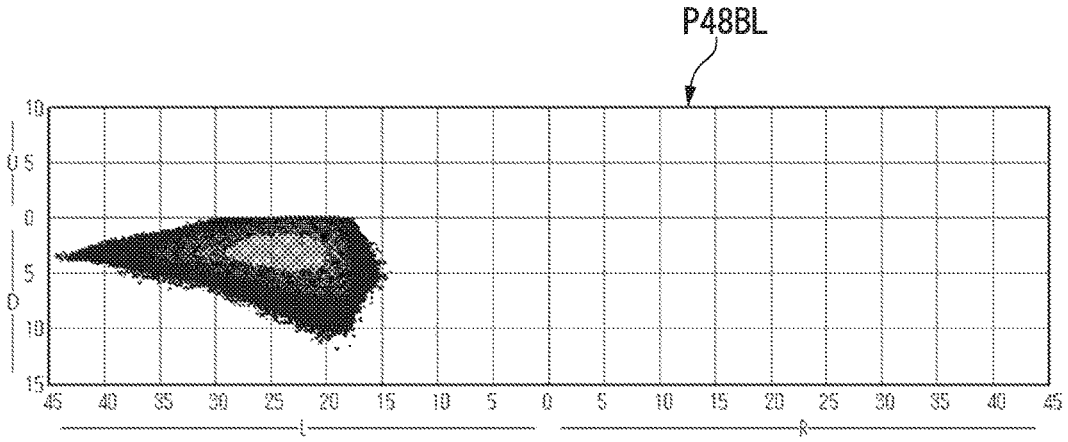
FIG. 12B shows a light distribution pattern of light radiated from different regions of the light emitting surface of the lens body of the first embodiment.
Figure 12C:
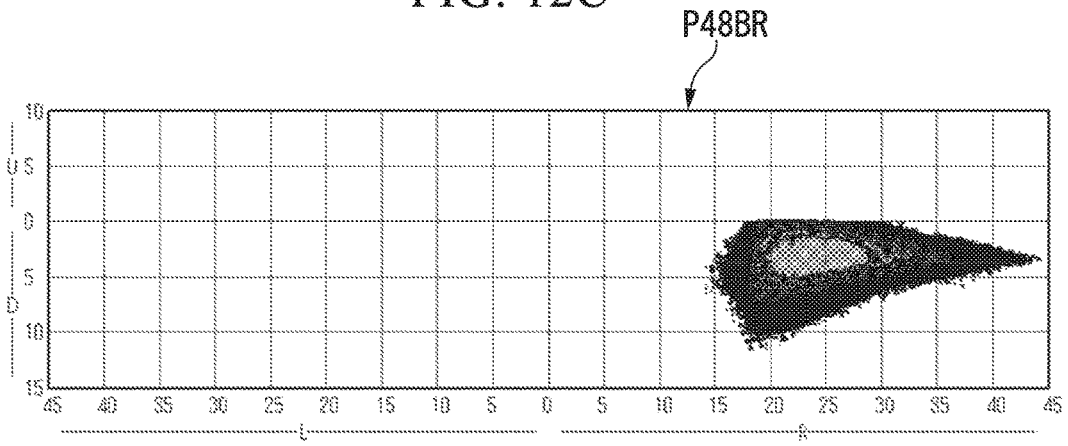
FIG. 12C shows a light distribution pattern of light radiated from different regions of the light emitting surface of the lens body of the first embodiment.

FIG. 12A to FIG. 12C are light distribution patterns of light radiated from different regions of the light emitting surface 48.

FIG. 12A is a view showing a light distribution pattern P48A of light radiated from the first leftward/rightward emission region 48A.

FIG. 12B is a view showing a light distribution pattern P48BL of light radiated from the second leftward/rightward emission regions 48B disposed on a left side of the forward/rearward reference axis $AX_{40}$ when seen from above.

FIG. 12C is a view showing a light distribution pattern P48BR of light radiated from the second leftward/rightward emission regions 48B disposed on a right side of the forward/rearward reference axis $AX_{40}$ when seen from above.

As shown in FIGS. 12A to 12C, it can be understood that the light radiated from the regions have distributions in different directions.

Figure 13:
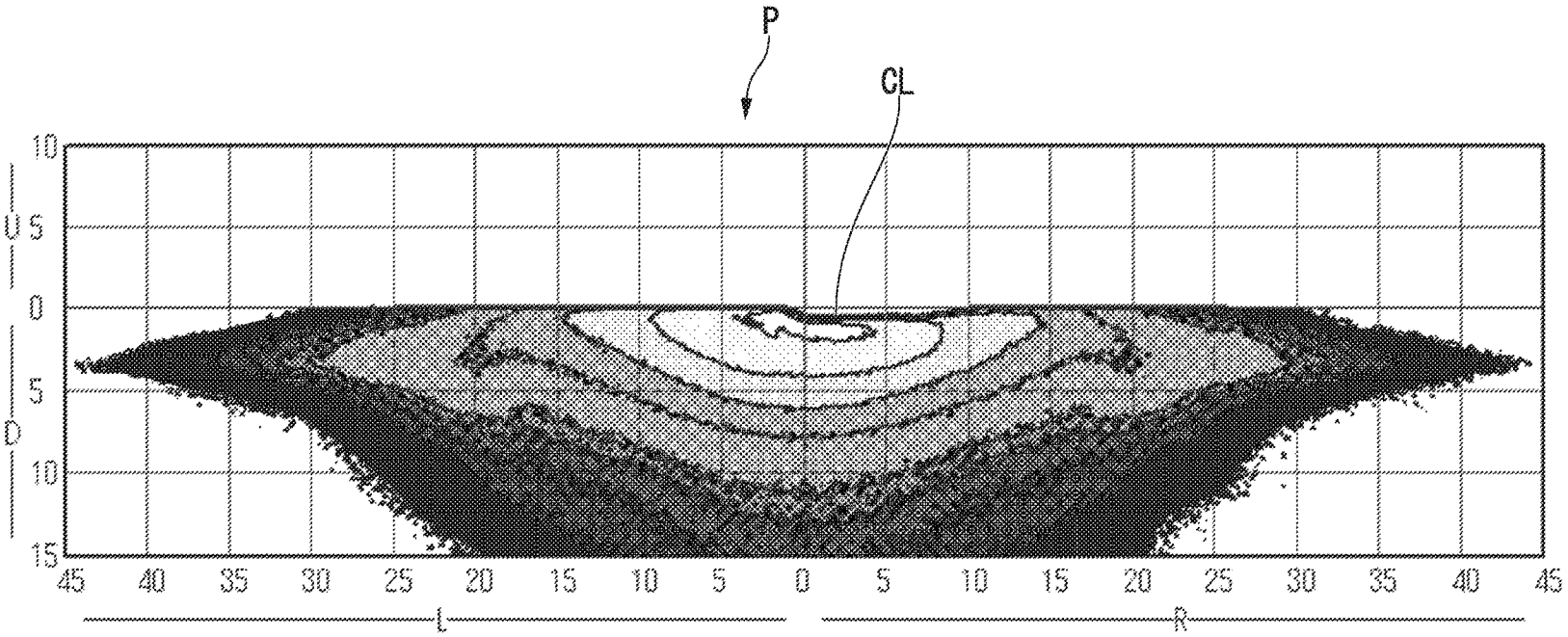
FIG. 13 shows a light distribution pattern of the light emitting surface of the lens body of the first embodiment.

FIG. 13 shows simulation results of a light distribution pattern P of light radiated to the imaginary vertical screen facing the lens body 40 in front of the lens body 40. The light distribution pattern P is a light distribution pattern in which the light distribution patterns P48A, P48BL and P48BR of FIGS. 12A to 12C overlap each other.

As shown in FIG. 13, it is known from the light distribution pattern P that light can be radiated forward widely with good balance. In addition, it was confirmed that the cutoff line CL having a step difference can be formed in the vicinity of a center of the light distribution pattern P.

While preferred embodiments of the invention have been described and illustrated above, it should be understood that these are exemplary of the invention and are not to be considered as limiting. Additions, omissions, substitutions, and other modifications can be made without departing from the scope of the present invention.

What is claimed is:

1. A lens body that is disposed in front of a light source and that is configured to emit light from the light source forward along a forward/rearward reference axis extending in a forward/rearward direction of a vehicle, the lens body comprising:

an incidence part through which the light from the light source enters;

a first reflecting surface that totally reflects the light entered from the incidence part;

a second reflecting surface that totally reflects at least some of the light totally reflected at the first reflecting surface; and a light emitting surface that emits the light passed through forward, wherein the first reflecting surface comprises an elliptical spherical shape with reference to a front focal point and a rear focal point that are disposed parallel with each other in the forward/rearward direction, the rear focal point is disposed in a vicinity of the light source, the second reflecting surface is formed as a reflecting surface extending from a vicinity of the front focal point toward a rear side, the light emitting surface has a convex shape in a cross section along a surface perpendicular to a leftward/rightward direction of the vehicle, the light emitting surface has a first leftward/rightward emission region through which the forward/rearward reference axis passes, and a second leftward/rightward emission region adjacent to the first leftward/rightward emission region in the leftward/rightward direction, the first leftward/rightward emission region refracts the entered light passed through the front focal point in a direction approaching the forward/rearward reference axis when seen in an upward/downward direction, the second leftward/rightward emission region refracts at least some of the entered light passed through the front focal point in a direction getting away from the forward/rearward reference axis when seen in the upward/downward direction, and among the light totally reflected at the first reflecting surface, a light that has reached the light emitting surface without being reflected at the second reflecting surface, and a light that has been totally reflected by the second reflecting surface and that has reached the light emitting surface, are radiated forward by being emitted from the light emitting surface, respectively.

2. The lens body according to claim 1, wherein the first reflecting surface has a first reflective region and a second reflective region respectively including an elliptical spherical shape with reference to the front focal point and the rear focal point that are disposed parallel with each other in the forward/rearward direction, the rear focal points of the first reflective region and the second reflective region coincide with each other, the front focal points of the first reflective region and the second reflective region are disposed at different positions when seen in the upward/downward direction, a light passed through the front focal point of the first reflective region is emitted forward via the first leftward/rightward emission region, and a light passed through the front focal point of the second reflective region is emitted forward via the second leftward/rightward emission region.

3. The lens body according to claim 2, wherein the light emitting surface has a single first leftward/rightward emission region, and a pair of the second leftward/rightward emission region respectively disposed on both sides of the first leftward/rightward emission region in the leftward/rightward direction, the first reflecting surface has a single first reflective region, and a pair of the second reflective region respectively disposed on both sides of the first reflective region in the leftward/rightward direction, a light passed through one of the front focal point among the pair of the second reflective region is emitted forward via one of the second leftward/rightward emission region among the pair of second leftward/rightward emission region, and a light passed through the other one of the front focal point among the pair of second reflective region is emitted forward via the other one of the second leftward/rightward emission region among the pair of second leftward/rightward emission region.

4. The lens body according to claim 2, wherein the front focal point of the first reflective region overlaps with the forward/rearward reference axis when seen in the upward/downward direction, and the front focal point of the second reflective region is disposed so as to be shifted from the forward/rearward reference axis in the leftward/rightward direction when seen in the upward/downward direction.

5. The lens body according to claim 2, wherein, in the first reflective region, a distance between the front focal point and the rear focal point;

an eccentricity;

an angle of a major axis, through which the front focal point and the rear focal point pass, with respect to the forward/rearward reference axis; and an angle of an optical axis of the light source with respect to the forward/rearward reference axis, are set so that the entered light is totally reflected at the first reflecting surface.

6. The lens body according to claim 2, wherein, in the second reflective region, a distance between the front focal point and the rear focal point;

an eccentricity;

an angle of a major axis, through which the front focal point and the rear focal point pass, with respect to the forward/rearward reference axis; and an angle of an optical axis of the light source with respect to the forward/rearward reference axis, are set so that the entered light is totally reflected at the first reflecting surface.

7. The lens body according to claim 2, wherein, in the first reflective region, the major axis through which the front focal point and the rear focal point pass is inclined with respect to the forward/rearward reference axis, and the rear focal point is disposed below the front focal point.

8. The lens body according to claim 2, wherein, in the second reflective region, the major axis through which the front focal point and the rear focal point pass is inclined with respect to the forward/rearward reference axis, and the rear focal point is disposed below the front focal point.

9. The lens body according to claim 1, wherein an angle of the second reflecting surface with respect to the forward/rearward reference axis is set such that the light totally reflected at the second reflecting surface among the light totally reflected at the first reflecting surface is captured by the light emitting surface.

10. The lens body according to claim 9, wherein an angle of the second reflecting surface with respect to the forward/rearward reference axis and a length of the second reflecting surface in the forward/rearward direction are set so that the second reflecting surface does not shield the light which is totally reflected at the first reflecting surface and which reaches the light emitting surface without being totally reflected at the second reflecting surface.

11. The lens body according to claim 1, wherein a front edge of the second reflecting surface extends forward from a central section thereof so that a portion positioned more outer side in the leftward/rightward direction is positioned more forward.

12. The lens body according to claim 11, wherein the second reflecting surface comprise a main surface section, and a subsidiary surface section shifted from the main surface section in the upward/downward direction, and at least a portion of a boundary section between the main surface section and the subsidiary surface section extends rearward from the front edge.

13. A lighting tool for a vehicle comprising: the lens body according to claim 1 and the light source.

* * * * *